US009214144B1

(12) United States Patent
Yang

(10) Patent No.: US 9,214,144 B1
(45) Date of Patent: Dec. 15, 2015

(54) SYSTEM AND METHOD FOR GENERATING SONG TRANSITIONS USING MEASURE GROUPINGS

(71) Applicant: Michael Yang, Princeton, NJ (US)

(72) Inventor: Michael Yang, Princeton, NJ (US)

(73) Assignee: Mixwolf LLC, Princeton, NJ (US)

( * ) Notice: Subject to any disclaimer, the term of this patent is extended or adjusted under 35 U.S.C. 154(b) by 141 days.

(21) Appl. No.: 13/950,276

(22) Filed: Jul. 24, 2013

Related U.S. Application Data

(63) Continuation of application No. 13/316,486, filed on Dec. 10, 2011, now Pat. No. 8,525,012, which is a continuation of application No. 13/281,405, filed on Oct. 25, 2011, now Pat. No. 9,070,352.

(51) Int. Cl.
*G10H 1/36* (2006.01)
*G10H 1/08* (2006.01)

(52) U.S. Cl.
CPC ..... *G10H 1/08* (2013.01)

(58) Field of Classification Search
CPC ..... G11B 27/038; G06F 17/30772; G10H 2240/131; G10H 1/40; G10H 2240/145; G10H 2210/076; G10H 1/0058; G10H 2240/325; G10H 2240/031; G10H 2210/131; G10H 2210/241; G10H 2240/135; G10H 2210/066; G10H 2210/071; G10H 2250/035; G10H 7/008
See application file for complete search history.

(56) References Cited

U.S. PATENT DOCUMENTS

| | | | | |
|---|---|---|---|---|
| 2004/0069123 | A1* | 4/2004 | Becker et al. | 84/612 |
| 2008/0013756 | A1* | 1/2008 | Roman et al. | 381/119 |
| 2008/0013757 | A1* | 1/2008 | Carrier | 381/119 |
| 2009/0249945 | A1* | 10/2009 | Yamashita et al. | 84/612 |

* cited by examiner

*Primary Examiner* — Marlon Fletcher
(74) *Attorney, Agent, or Firm* — Neel U. Sukhatme

(57) ABSTRACT

A system and method are provided for mixing song data based on measure groupings. A player or program may recognize measure groupings in a song through identifying cuepoints. The player or program may use the cuepoints and/or other identifiers of measure groupings to generate a transition between the song and other songs. Parts of one or both songs may be time-stretched, or frames may be added or deleted, such that the beats in both songs are substantially aligned during the transition. The system and method may also involve altering the sequence of frames in one or both of the songs, so that the transition may have various sonic qualities as desired by a user. A choice of transition modes may be provided via a user interface that allow the user some control over when and how transitions between songs are executed.

18 Claims, 34 Drawing Sheets

SYSTEM AND METHOD FOR GENERATING SONG TRANSITIONS USING MEASURE GROUPINGS

CROSS-REFERENCE TO RELATED APPLICATIONS

This application is a continuation of prior U.S. patent application Ser. No. 13/316,486, entitled "System and Method for Selecting Measure Groupings for Mixing Song Data," and filed Dec. 10, 2011, by the present inventor, Michael Yang ("'486 application"). The '486 application is in turn a continuation of prior U.S. patent application Ser. No. 13/281,405, entitled "System and Method for Mixing Song Data Using Measure Groupings," and filed Oct. 25, 2011, by the present inventor, Michael Yang ("'405 application"). This application claims priority to and incorporates by reference the '405 application and the '486 application.

FIELD

The present invention relates to digital music and digital music players.

BACKGROUND

Digital music continues to grow in popularity. Millions of people purchase MP3s or other digital music online and via applications on their mobile devices. Millions more subscribe to music services that stream digital music on demand via the Internet or other networks.

Many people who listen to music use a conventional digital music player, such as iTunes®, WinAmp®, or Windows Media Player®. Such digital music players often have a "playlist"—a list of songs that the user has selected and that will be played in the order specified in the list.

A limitation of conventional digital music players is that they do not allow for seamless playback of songs. Namely, when one song in the playlist ends, there is often an abrupt break or a pause before the next song begins. This might be particularly noticeable when a currently playing song has a tempo or pitch that differs from a song that plays next. Moreover, even if a player could blend one song into the next, the transition between the two would not be aligned according to the tempo of each song, and would not take into account what portions of the two songs match on the basis of measure or song section. Additionally, conventional players do not allow a seamless way to layer one song on top of another.

The lack of seamless transition between songs is less than ideal for many users. For example, a user who is listening to dance music, hip hop, or music produced by disc jockeys may wish to have a continual music listening experience, with no audible gap when one song plays and the other begins. Such a user might want a new song to start playing at a particular portion that correlates to a portion of the currently playing song, or wish to layer two songs together. Similarly, a user who is playing music at a party, or in a bar or club may also wish to have music that seamlessly plays in such a manner. Unfortunately, conventional digital music players do not allow for such functionality.

SUMMARY

One aspect of an exemplary embodiment involves a method for mixing songs based on measure groupings. Such a process may involve identifying a first measure grouping in a first song and a second measure grouping in a second song, generating a transition based on these measure groupings, and determining if an advance signal has been triggered.

Another aspect of an exemplary embodiment involves a method for mixing songs using frame sequences from a first song and a second song. Each of the frame sequences may include some part of a measure grouping. The method might also involve selecting subsequences from each of the frame sequences and generating a transition based on the subsequences.

A third aspect of an exemplary embodiment may involve an apparatus for mixing music. The apparatus may have a memory unit that stores transition data. This transition data may include cuepoints that mark one or more measure groupings in songs. The apparatus may also include a transition generation unit, which uses the cuepoints to generate a transition between songs. The apparatus may further have a player that truncates playback of a first song and begins playing the transition in response to an advance signal.

DETAILED DESCRIPTION

Figure 1A:
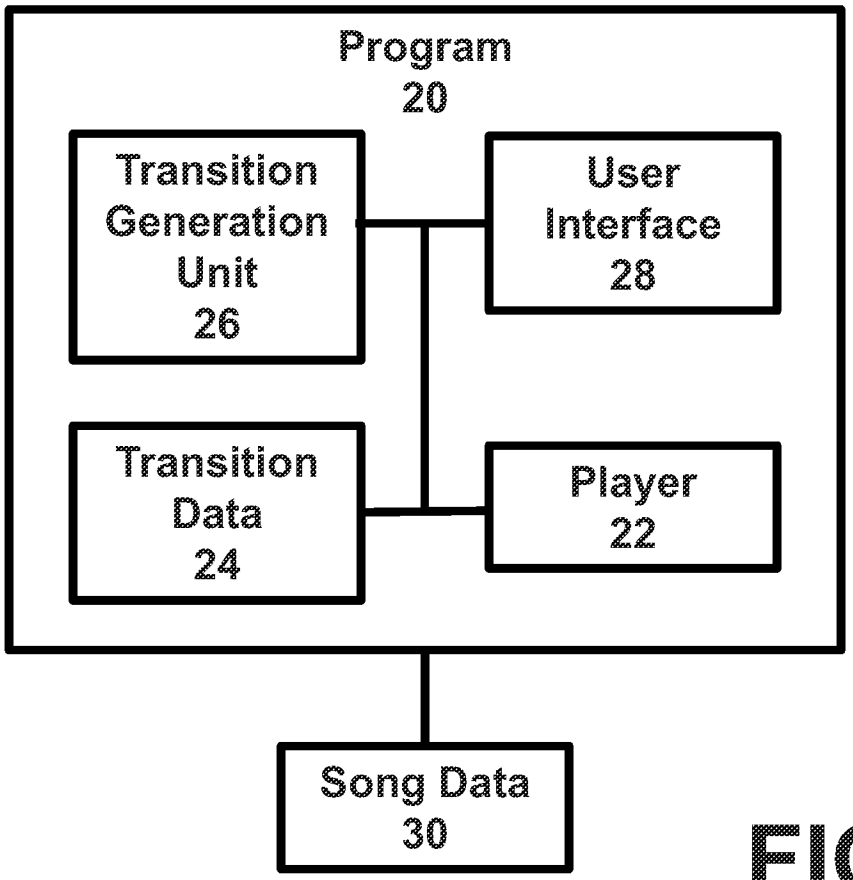
FIGS. 1A-1B are block diagrams illustrating exemplary embodiments for mixing song data based on measure groupings.

FIGS. 1A-1E—Exemplary Embodiments for Mixing Song Data and Producing Transitions FIG. 1A shows one exemplary embodiment. A computer system runs a program 20 that includes a player 22, a user interface 28, transition data 24, and a transition generation unit 26. The computer system may be a standard personal computer, laptop, notebook, tablet computer, or any other kind of computing device, such as a mobile phone, smart phone, or embedded system. The program 20 may be any kind of computer program, such as a standalone program that resides on the computer system (e.g., an application on a mobile device), and/or a program that operates via an Internet browser.

As represented by the interconnected lines within the program 20, the components within the program 20 may communicate or send data to one another via messages encoded in software and/or hardware, and the program 20 might be implemented in software and/or hardware. The program 20 interfaces with song data 30, which might be one or more songs or other musical compositions or audio files. For example, the song data 30 might include full songs, combinations or mixes of songs, portions of songs, transformed versions of songs (such as time-stretched versions), voice snippets, advertisements, and/or preview clips.

To illustrate, a voice snippet may be a beat-oriented announcement from a disc jockey or radio station, and an advertisement might be an advertising announcement that has a beat and is beat-matched to mix with songs. A preview clip may be, for example, a thirty-second or one minute segment of a song that enables potential customers to hear part of the song before they decide whether to buy it.

It should be understood that this list of song data 30 is meant to be illustrative and not limiting. Many other types of audio or media may be part of the song data 30 such as, for example, multimedia tracks (e.g., video or light tracks cued to music or sound in some way), model-based or sample-based synthesized music, (e.g., grand piano, drum pad sounds), MIDI clips, or beat tracks (e.g., "Latin" rhythms).

The song data 30 may be stored in any number of different formats, such as MP3, Ogg, WAV, and so on. Moreover, the song data 30 may be stored directly on a memory unit on the computer system, such as in random-access memory, read-only memory, flash, or any other storage mechanism. Alternatively, the program 20 may access the song data 30 via a network (such as the Internet, wireless broadband network, or broadcast system) or a physical cable (such as USB, FireWire, etc. cables). It should be understood that the terms "song data", "song", and "songs" may be used interchangeably, and that the use of any of these terms encompasses the others. It should also be understood that although the program 20 directly connects with the song data 30 here, any of the components within the program 20 might additionally or alternatively connect directly with the song data 30.

Figure 1B:
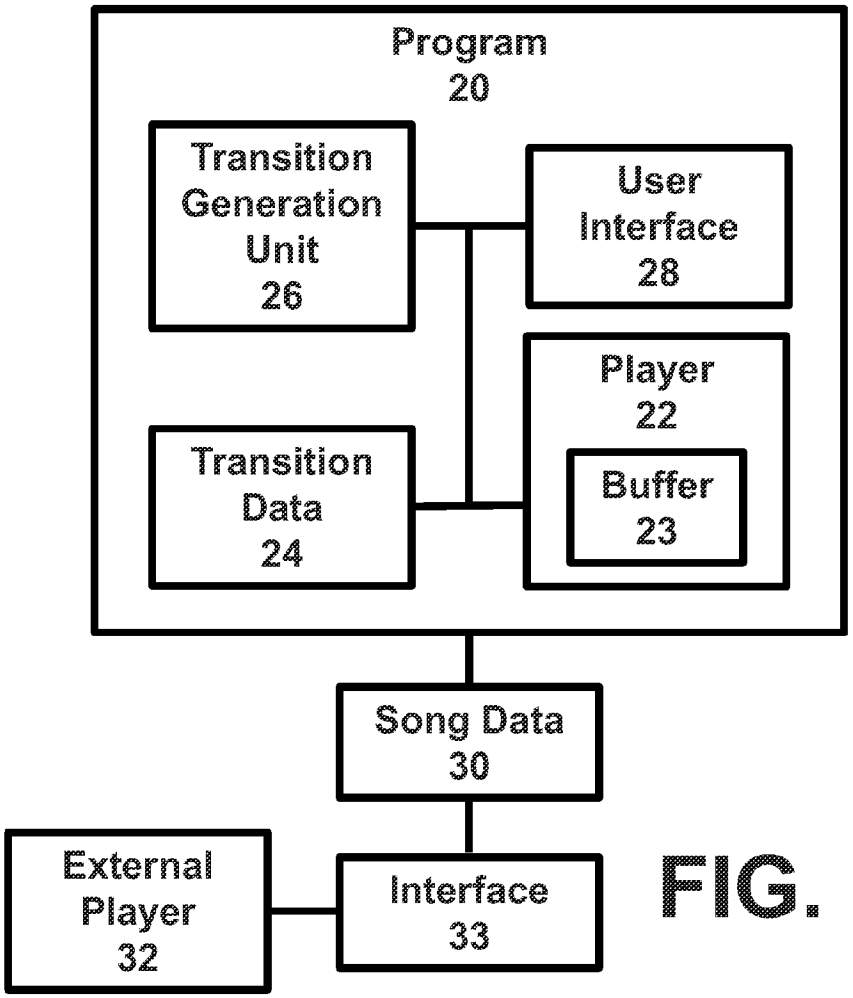

The player 22 transforms the song data 30 into an audio output. As shown in FIG. 1B, the player may include a playback buffer 23. Alternatively, the buffer 23 may be external to the player or integrated with other components in the computer system. The buffer 23 may be implemented in hardware or software or in any other way in which music may be buffered for playback by a digital music player. The buffer 23 may store the song data 30 or information about the song data 30 (such as title, artist, genre, playback time, etc.), which may then be played by the player 22.

As noted, the song data 30 might be presented to the player 22 in a variety of formats. Moreover, as shown in FIG. 1B, an external music player 32 may generate an output that is received via an interface 33 as the song data 30 for the program 20. For example, the computer system or program 20 may use an interface 33 to capture an audio or electronic output of the external player 32, such as in a raw or compressed URL format. The program 20 may use that output as the song data 30, which may be stored separately or in the playback buffer 23 for the player 22. So instead of the output of the external player 32 being sent to a speaker (or in addition to it being sent by a speaker), the output may be received by the program 20. It should be understood that the program 20 may receive this data from the external player 32 over any kind of connection, such as a link to a file on a hard drive or a link to a network via, for example, a URL or network request.

The program 20 could then process the song data 30 to enable it to mix with other songs. Such an embodiment would allow the components described here to connect with "off-the-shelf" standard music players that are not beat-aware or do not have intelligence built-in to mix songs together. Such an external player 32 (which may be implemented in software, hardware, or a combination of the two) would produce the song data 30 to be received by the buffer 23 or other memory unit associated with the program 20. The song data 30 may then be processed by the transition generation unit 26 such that it might be mixed with another song. Alternatively, the program 20 might control the external player 32, muting it while the player 22 plays the song data 30.

Moreover, the buffer 23 or another buffer (which might be in the program 20 or the interface 33) might be used as a look-ahead buffer that can be used to identify the next song that is being played by the external player 32. This might be useful when the program 20 is trying to identify the next song being played so it can generate a beat-matched, measure-aware transition to that song.

The interface 33 that enables the external player 32 to communicate with the program 20 may be implemented in software and/or hardware. For example, the interface 33 may be a pass-through device that can be fitted on any conventional music player and that connects separately to the computer system. Alternatively, the interface 33 may be part of the program 20, or it might be a software add-on or hardware addition to the external player 32.

It should be understood that the player 22 and/or any accompanying buffer 23 might have various physical components attached to or integrated within it. For example, the player 22 might be part of a physical speaker system that transforms electrical signals into sound. Or the player 22 might simply output the song data 30 or some electronic transformation of it to a physical speaker device. The player 22 might also just play the song data 30 provided to it, or alternatively, buffer additional data that it then outputs to the physical speaker device.

Other types of intelligence might be part of the player 22 as well, such as software or hardware that enable the player 22 to store the song data 30 for later retrieval and playback, to simultaneously buffer and play back streams of the song data 30, to pause and resume playback, or to jump to a specific location in the song data 30. Indeed, in some embodiments, the entire program 20 may be colloquially referred to as "the player" by users. It should be understood that the preceding description is not meant to be limiting and is intended merely to show exemplary features that might be part of the player 22. For example, the player 22 might concatenate one or many buffered streams together or fade out one song while fading in another.

Figure 7A:
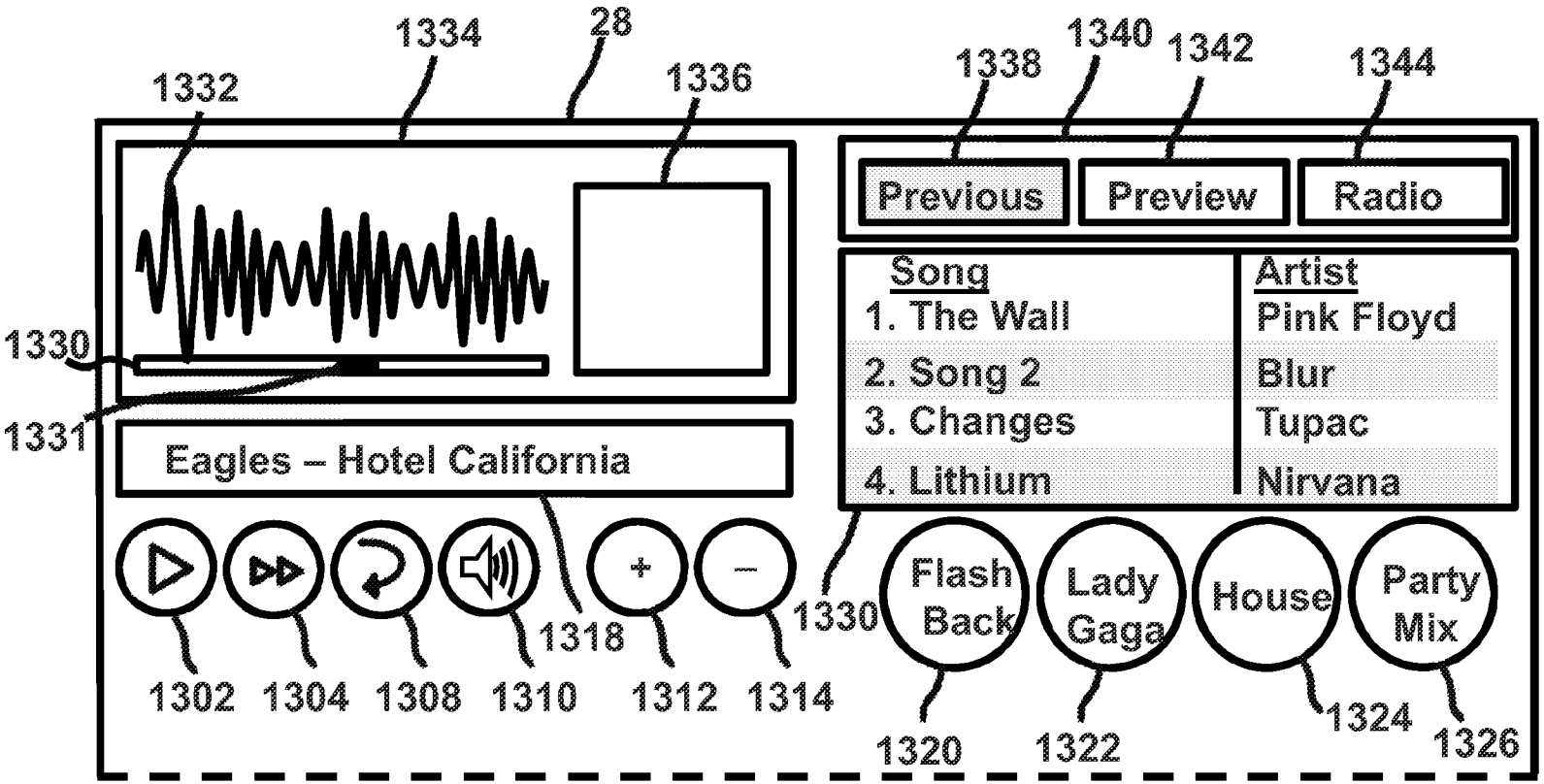
FIGS. 7A-7B show an exemplary user interface.
Figure 7B:
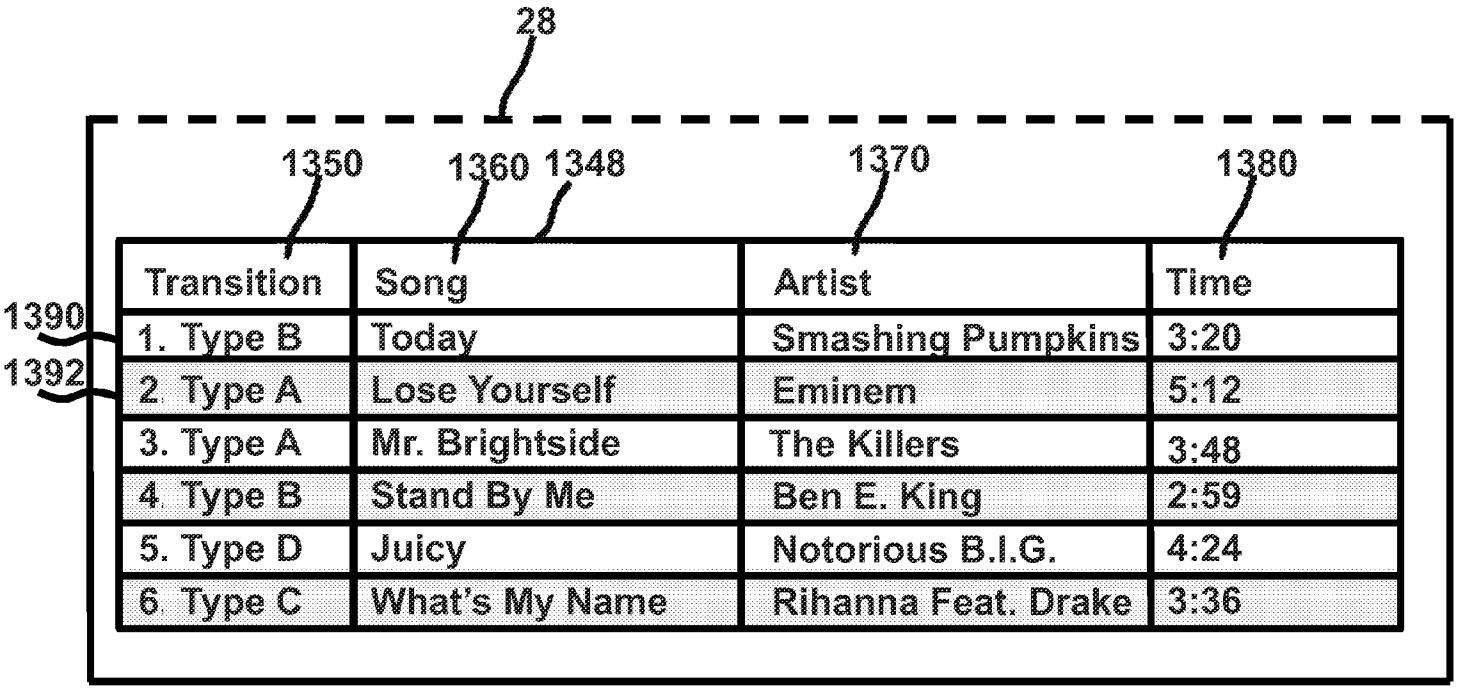

As shown in FIGS. 1A-B, the program 20 also has a user interface 28. This interface 28 may be a graphical user interface, text user interface, voice user interface, touchscreen, web user interface, gesture interface, command line interface, motion tracking interface, intelligent user interface, or any other interface that allows a user to interact with a program. Via the interface 28, the user might, for example, specify songs he would like to play and the manner in which they should be played, or provide information about how transitions between songs should be played. The user interface 28 could also provide information about current playback of songs, and also about future, or "enqueued," songs, such as the next song to be played. More examples of how a user might interact with the user interface 28, and what such an interface 28 might contain, are shown in FIGS. 7A-B and are discussed later in this description.

The program 20 also includes transition data 24, which may be generated based on the song data 30. The transition data 24 may be stored on the same memory unit as the song data 30, or it might be stored on a separate memory unit.

Alternatively, similar to the song data 30, in some embodiments the program 20 may access the transition data 24 via a network or a physical cable.

Figure 1C:
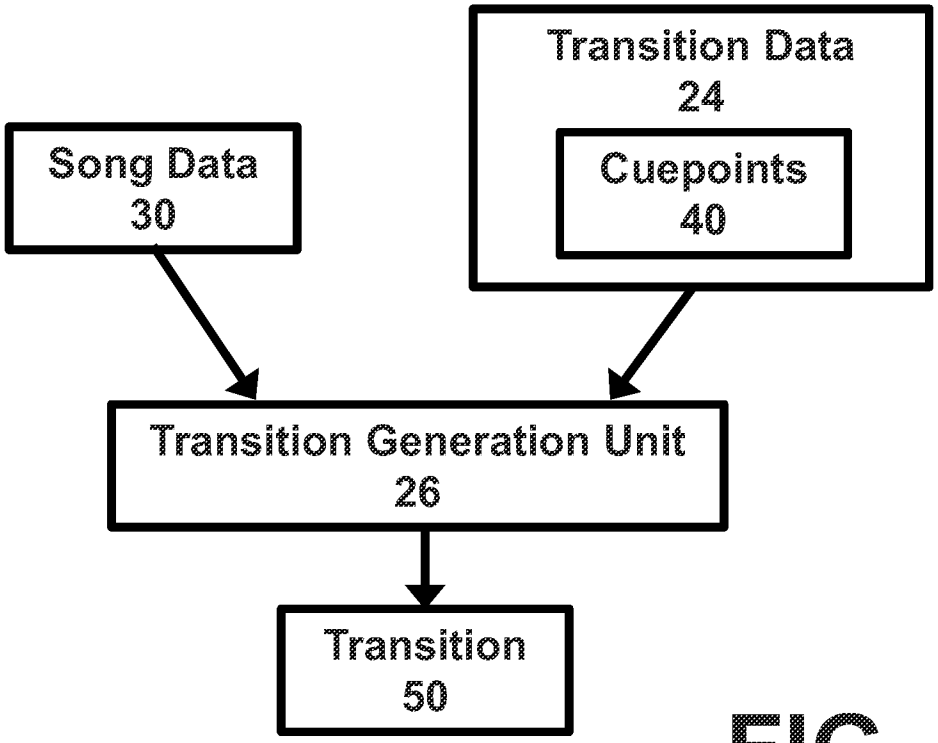
FIGS. 1C-1D are block diagrams illustrating exemplary embodiments for producing a transition between songs.

As shown in FIG. 1C, the transition data 24 includes cuepoints 40, which might mark off certain "dominant beats" or other specific points in the song data 30. In particular, the cuepoints 40 might mark off measure groupings, which might be groups of one or more measures in the song. The measure groupings might be segments of the song data 30 that naturally go together and can be rejoined with other songs or song portions.

For example, the cuepoints 40 might mark boundaries of the measure groupings by marking "startpoints" that partition the song data 30 into the measure groupings. Alternatively, the cuepoints 40 might be separated from the boundaries of measure groupings by some number of frames; for example, each of the cuepoints 40 might mark a point prior to the start of a measure grouping by some pre-specified offset. The cuepoints 40 might also specify a midpoint or some other point that identifies a measure grouping. In an exemplary embodiment, the cuepoints 40 may be determined by one or more people who listen to the song data 30 and identify the measure groupings.

It should be understood that this description is exemplary and not meant to be limiting, and that the cuepoints 40 might be used in any way to identify a part of the song. For example, in some embodiments, each of the cuepoints 40 might identify a set of points in the song. Or each of the cuepoints 40 might actually be a range of values corresponding to the range of frames encompassed by a measure grouping.

The cuepoints 40, as well as beats or other position markings in the song, may be marked off based on frame number, time, sample segment, or in any other way in which the song data 30 may be discretized. It should be understood that "frame number" as used throughout this specification is a flexible term that covers any index or other way of measuring a position or sample in a song. For example, frame number may refer to an absolute frame number, which identifies a frame by its position in the song data 30 relative to a start of the song data 30 (e.g., the beginning of a song). In such a scheme, when a song is sampled at 44,100 samples per second (a standard sampling frequency that is often used), a sample pulled after exactly 10 seconds of playback from the beginning of the song will have a frame number of 441,001 (or approximately that number, if there is an offset or some distortion that affects the frame numbers).

A sample that is identified by such a frame number may contain one frame (e.g., if the audio output is mono) or two frames (e.g., if the audio output is stereo), or some other number of frames (e.g., for surround sound or other forms of more complicated audio playback). So in some embodiments, a frame number may be used to identify more than one actual frame of audio data, depending on the number of frames contained within a sample identified by the frame number. Alternatively, each frame within a sample may be separately identified through a frame number. Returning to the example above, if a song sampled at 44,100 samples per second is a stereo song, a sample pulled after exactly 10 seconds of playback might have two frame numbers associated with it, with one corresponding to each audio output channel (e.g., the frame numbers might be 882,001 and 882,002, which equals 2*441,001).

A frame number might also encompass a relative frame number, which marks the number of frames from some other arbitrary point in the song data 30 rather than the beginning. Alternatively, a frame number may refer to a time stamp, which measures the time in the song relative to the beginning of the song data 30. Or a frame number might encompass a relative time stamp, which measures the time in the song relative to some other arbitrary time in the song data 30.

The preceding discussion is intended merely to illustrate some of the ways in which a frame number may be used. Many other ways of marking frames and using frame numbers are possible, such as by using some transformation (e.g., function) of an absolute frame number, relative frame number, time stamp, or relative time stamp.

Returning to the cuepoints 40, they may also be used for purposes not directly related to cutting or appending to the song data 30. For example, cuepoints 40 might be used as a general reference point to indicate what portion of the song data 30 the player 22 has reached. To illustrate, if the player 22 or its playhead reach a cuepoint that corresponds to a final portion or measure grouping in the song data 30, the player 22 might provide a signal to the program 20 that a transition to a new song may be wanted soon.

The cuepoints 40 might also serve as section boundaries between different portions of the song data 30. These section boundaries might, for example, be the beginning or ending points of musical measures or musical sections (like chorus, verse, bridge, intro, outro, etc.) in the song data 30. Of course, the preceding description is intended to be exemplary and not limiting as to the potential uses of the cuepoints 40 in the present embodiment.

Figure 1D:
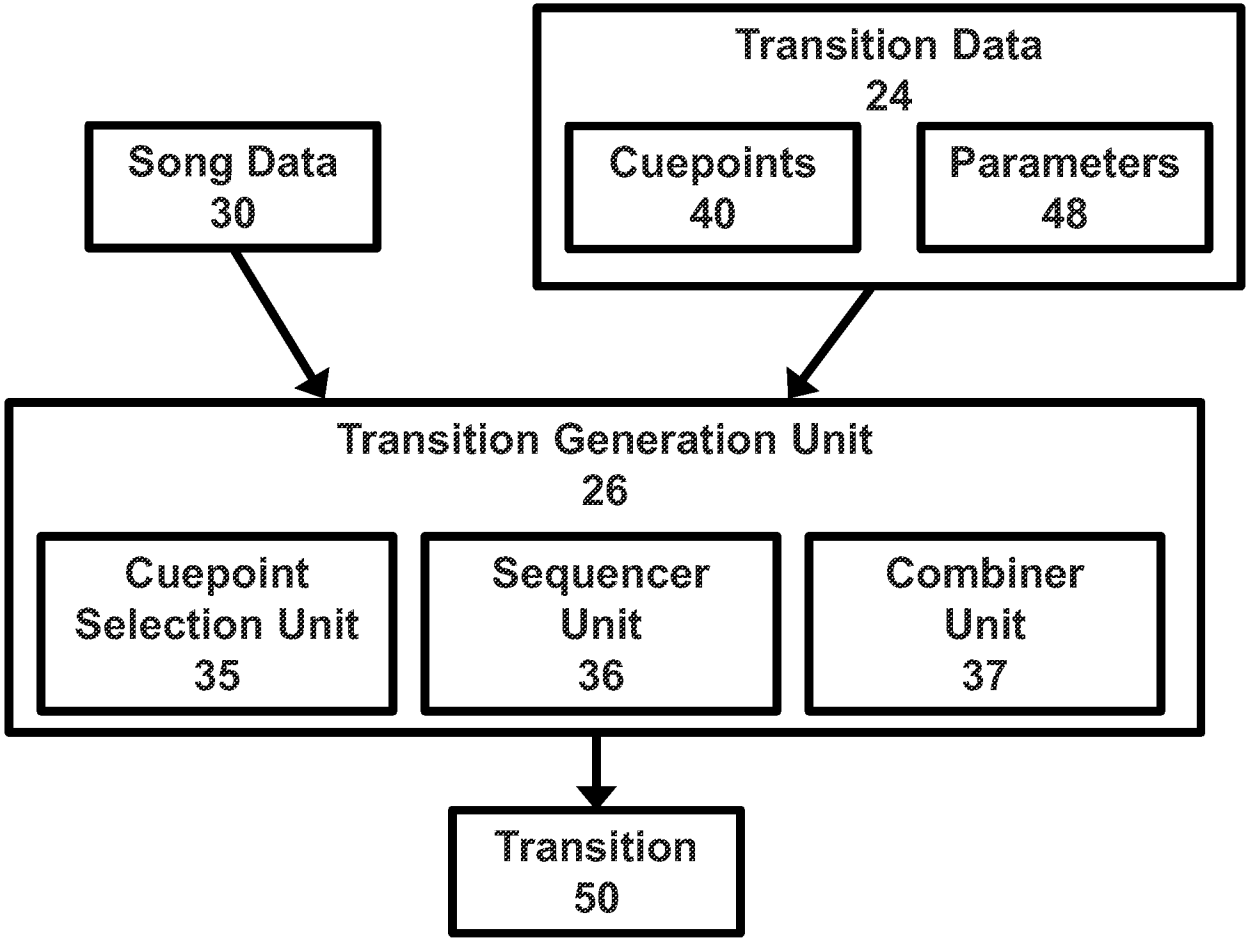

The transition data 24 might also include elements other than cuepoints 40. For example, as shown in FIG. 1D, the transition data 24 might include parameters 48 related to the song, such as fade profiles, bass and treble profiles, filters, cuepoint delay offsets, cuepoint groupings, and musical keys or pitches. These parameters 48 might be provided for any part of a song (e.g., measure grouping) or at the song level.

This list is just exemplary, and other information may also be part of the transition data 24. For example, the transition data 24 and/or parameters 48 might also include duration adjustments, beat drop-out locations, and beat rate adjustments.

The program 20 also includes the transition generation unit 26. This unit 26 may be comprised of software and/or hardware components that manipulate or otherwise treat the transition data 24 in a number of different ways. For example, the transition generation unit 26 might select a subset (i.e., one or more, up to and including all) of the cuepoints 40 when mixing together the song data 30. Alternatively, as shown in FIG. 1D, the unit 26 might contain a cuepoint selection unit 35, which is a software and/or hardware unit that performs this function.

Also in FIG. 1D, we see the transition generation unit 26 might contain a sequencer unit 36, which is a software and/or hardware unit that selects frame sequences (e.g., sequences of consecutive or non-consecutive frames) from the song data 30. These frame sequences might be selected based on measure groupings and/or cuepoints 40 associated with one or more songs in the song data 30. Moreover, the sequencer unit 36 might also select subsequences, which might include parts of the frame sequences and other portions of the song data 30, such as parts of different songs. How frame sequences and subsequences might be chosen will be discussed in more detail later in this description.

The transition generation unit 26 might also include a combiner unit 37, which might combine frame values for frames based on the particular frame mapping. The combiner unit 37 (or alternatively, another component in the program 20) might use the cuepoints 40 in the transition data 24 to partition, reorder, join together, or mix together the song data 30. The combiner unit 37 (or other component) might further use the parameters 48, such as bass and treble profiles in transition data 24, to vary the volume and dynamic range of specific frequencies of the song data 30 over time. The combiner unit 37 may also be implemented in software and/or hardware. Discussed later in this description are exemplary embodiments showing how frame values might be combined.

This description of the transition generation unit 26 is not meant to be limiting, and many other ways of transition generation are possible. For example, the unit 26 might also use filters in the parameters 48 to transform and process the song data 30. Moreover, it should be understood that in other embodiments, any of the components 35-37 within the transition generation unit 26 might be combined, separated from the unit 26, or removed altogether. For example, the cuepoint selection unit 35, the sequencer unit 36 and/or the combiner unit 37 may be joined together or separate from the unit 26. Alternatively, the unit 26 might have a separate mapping unit (not shown) that generates a frame mapping between frames and/or subsequences that the combiner unit 37 uses when combining frame values.

In FIGS. 1C-D, we see that the transition generation unit 26 uses the transition data 24 and the song data 30 to generate a transition 50. The transition 50 might be a piece of the song data 30 that has been modified by the unit 26. The transition 50 might include pieces of two separate songs, with certain aspects of both songs (e.g., sound, volume, mix, beats per minute (BPM), duration, offset) varied. As discussed in more detail below, the transition 50 can serve as a bridge between two songs, allowing for beat-matched playback.

Figure 1E:
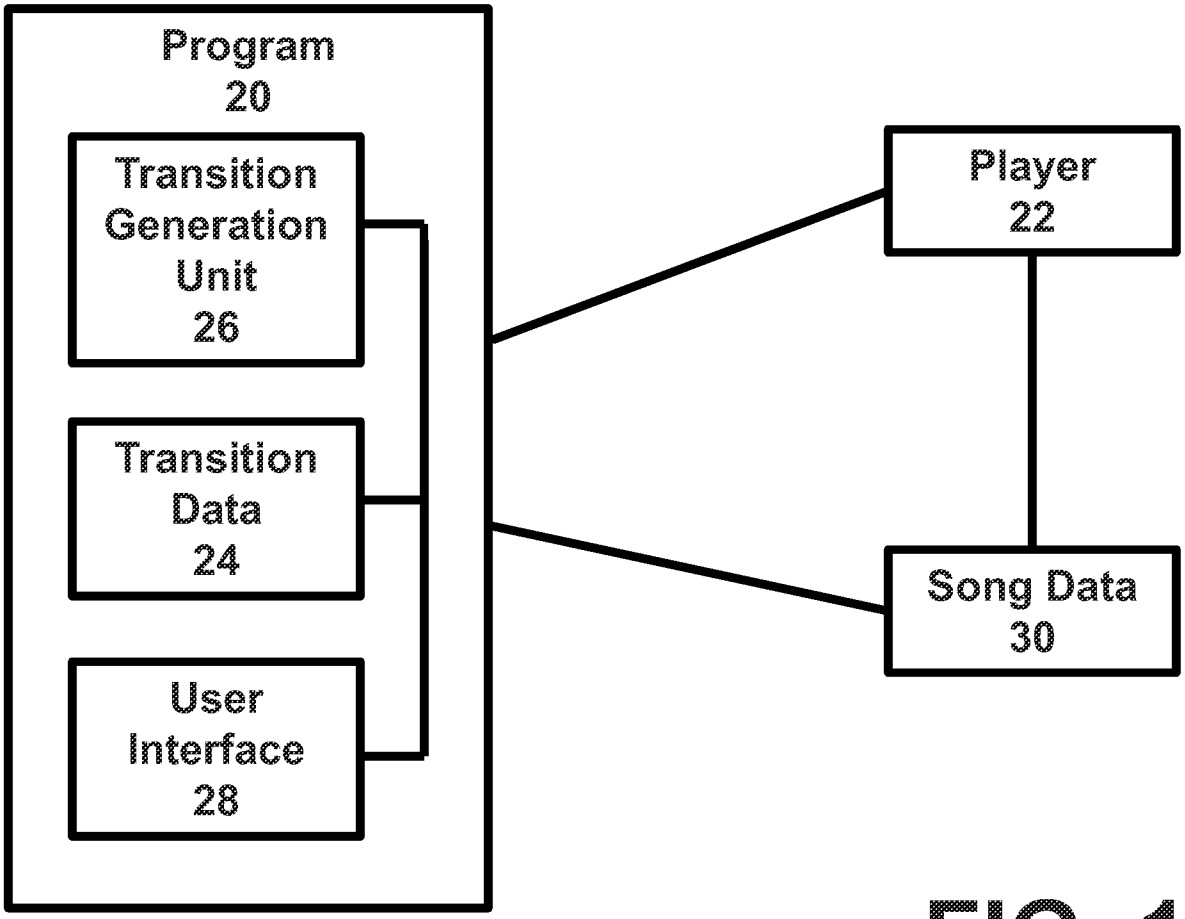
FIG. 1E is a block diagram illustrating another exemplary embodiment for mixing song data based on measure groupings.

Although some of the components in FIGS. 1A-1D are shown as separate, it should be understood that any of them might be incorporated within one another. For example, the user interface 28 might be part of the player 22, or the player 22 may directly include the transition generation unit 26. Alternatively, as shown in FIG. 1E, the player 22 might be separate from the program 20, and the song data 30 may be separately accessed by both the player 22 and the program 20.

Furthermore, it should be noted that although the transition data 24 and the song data 30 are not shown as interconnected in these embodiments, they may be connected in any way. For example, the transition data 24 and the song data 30 might be interspersed together when stored. In one embodiment, the transition data 24 might be stored in a header within the song data 30. Such an embodiment would allow the song data 30 and the transition data 24 to be available together, such that the program 20 might have the ability to mix song data 30 without accessing a remote network or other external data.

In another embodiment, the cuepoints 40 (or any parameters 48) might be marked within the song data 30, perhaps by some sequence of frame values or silent frames at various points corresponding to measure groupings in the song 30. For example, the cuepoints 40 might correspond to some arbitrary frame value (e.g., 0.013) or some sequence of frame values (e.g., 0.12, 0.013, 0, −0.11) that has been predetermined. When the program 20 encounters a frame or sequence of frames in the song data 30 with these values, it could recognize the position of the frame as a cuepoint for the song data 30. The cuepoint might mark, for example, the boundary of a measure grouping in the song data 30. Alternatively, the cuepoint might mark a point that is some predetermined offset from the boundary of the measure grouping, so the boundary of the measure grouping can be determined using the cuepoint and the offset.

If the sequence of frame values used to encode the cuepoints 40 in the song data 30 is relatively short, it will likely not be audible by a person listening to the song data 30 as it is played back. For example, some listeners cannot discern snippets of less than about 10 milliseconds of song data 30, which corresponds to about 440 frames if the song data 30 is sampled at 44,100 samples per second. Other listeners may not discern snippets on the order of about 100 milliseconds of song data 30, which would correspond to about 4400 frames at the 44,100 sampling frequency. So if the cuepoints 40 are encoded within the song data 30 in sufficiently small segments, it is possible they will have no discernible impact on playback of the song data 30.

FIG. 2A-2E—Exemplary Embodiments for Mixing Song Data Using a Network

Figure 2A:
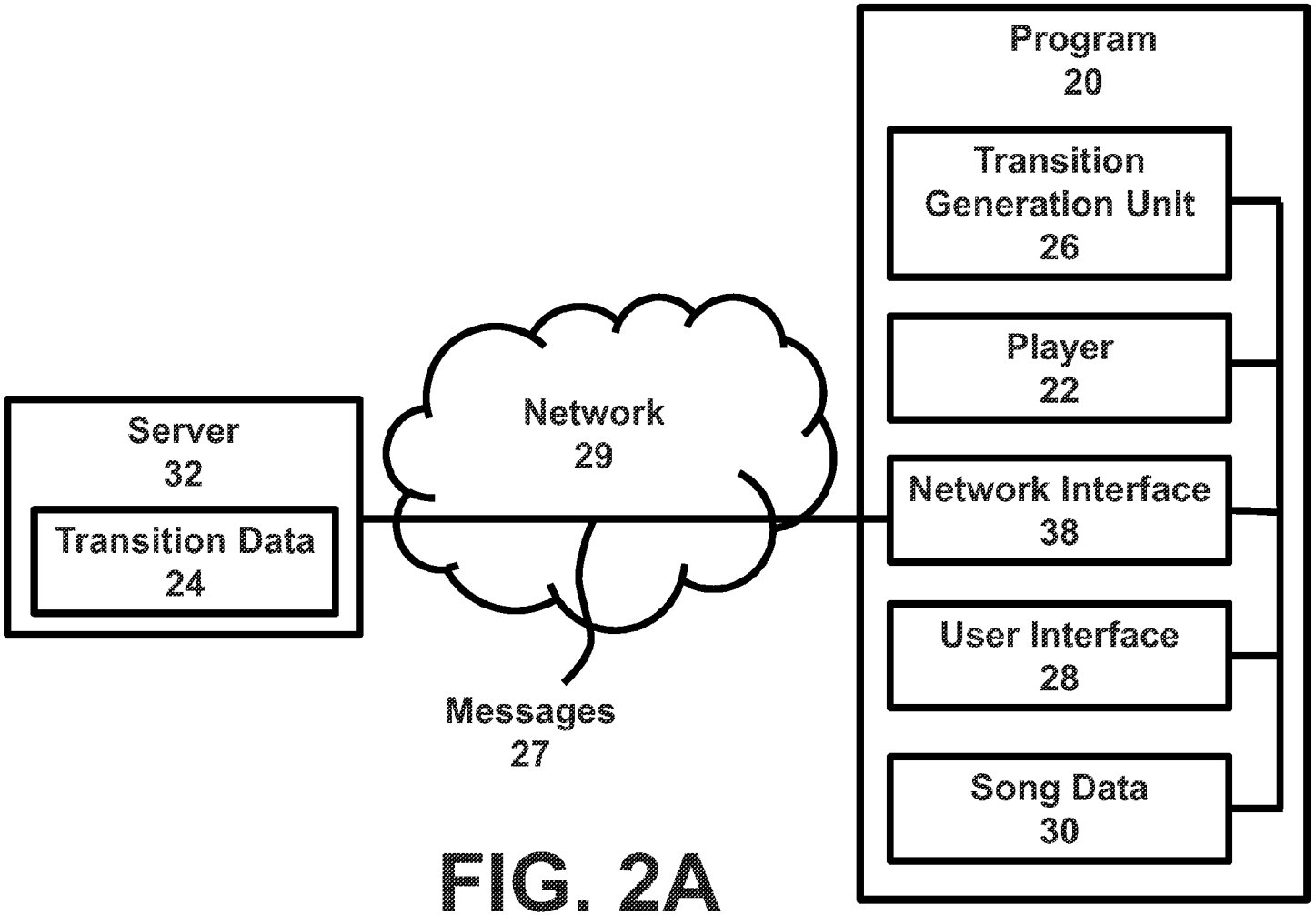
FIGS. 2A-2E are block diagrams illustrating exemplary embodiments for mixing song data using a network.

As noted previously, the player 22, the program 20, and the song data 30, may be physically connected on the same computer system or connected remotely via a network. For example, as shown in FIG. 2A, the components may be separated with components belonging to a server 32 (which might be any kind of remote data source, computing system, or storage unit) and the program 20. The server 32 and the program 20 might be separate software programs running on separate computers and communicating with one another via messages 27 over a network 29. One or both of them might contain hardware elements. The program 20 might contain a network interface 38 that enables it to communicate with the server 32. Such an interface 38 might be, for example, an Ethernet controller, router, wireless receiver, or any other packet-switching device. The network 29 might be, for example, the Internet, wireless broadband network, broadcast system, or mobile telecommunications network, such as a 3G or 4G wireless network.

Messages 27 may stream from the server 32 to the program 20 in both directions. In the embodiment shown in FIG. 2A, these messages 27 might contain the song data 30 and the transition data 24 sent from the server 32, and signals generated by the player 22 and the user interface 28 in the program 20. For example, the program 20 might send messages 27 that comprise identification tags for one or more songs that the program 20 might use to generate a transition 50. The identification tags might be used to query one or more predetermined lookup tables (not shown) on the server 32. The predetermined lookup tables might in turn store the transition data 24, including the cuepoints 40 and/or the parameters 48 (which might, for example, comprise a beat map or other parameters used by the program 20 to generate the transition 50). The server 32 may then stream to the program 20 the transition data 24 for the songs whose identification tags were sent by the program 20. The messages 27 may be encoded using any number of various protocols (e.g., TCP/IP, HTTP, FTP, UDP, POP3, IMAP, OSI, etc.).

It should be understood that any of these components might be distributed between the server 32 and program 20 in a variety of ways. For example, as discussed regarding the embodiment shown in FIG. 2A, the song data 30 may be stored on a storage device or memory unit with the program 20, but the transition data 24 may be stored on the server 32. In such an embodiment, the server 32 might stream the cuepoints 40 and/or the parameters 44 for particular songs to the program 20, which in turn would use the transition generation unit 26 to generate a transition 50 (as shown previously in FIGS. 1C and 1D).

Such an embodiment might be useful, for example, for mobile devices. The program 20 could be any program or "app" on the mobile device, and the server 32 could stream the transition data 24 to the program 20, which could in turn generate the transition 50. The transition data 24 may then be cached with the program 20 or restreamed to the program 20 each time the data 24 is used.

Figure 2B:
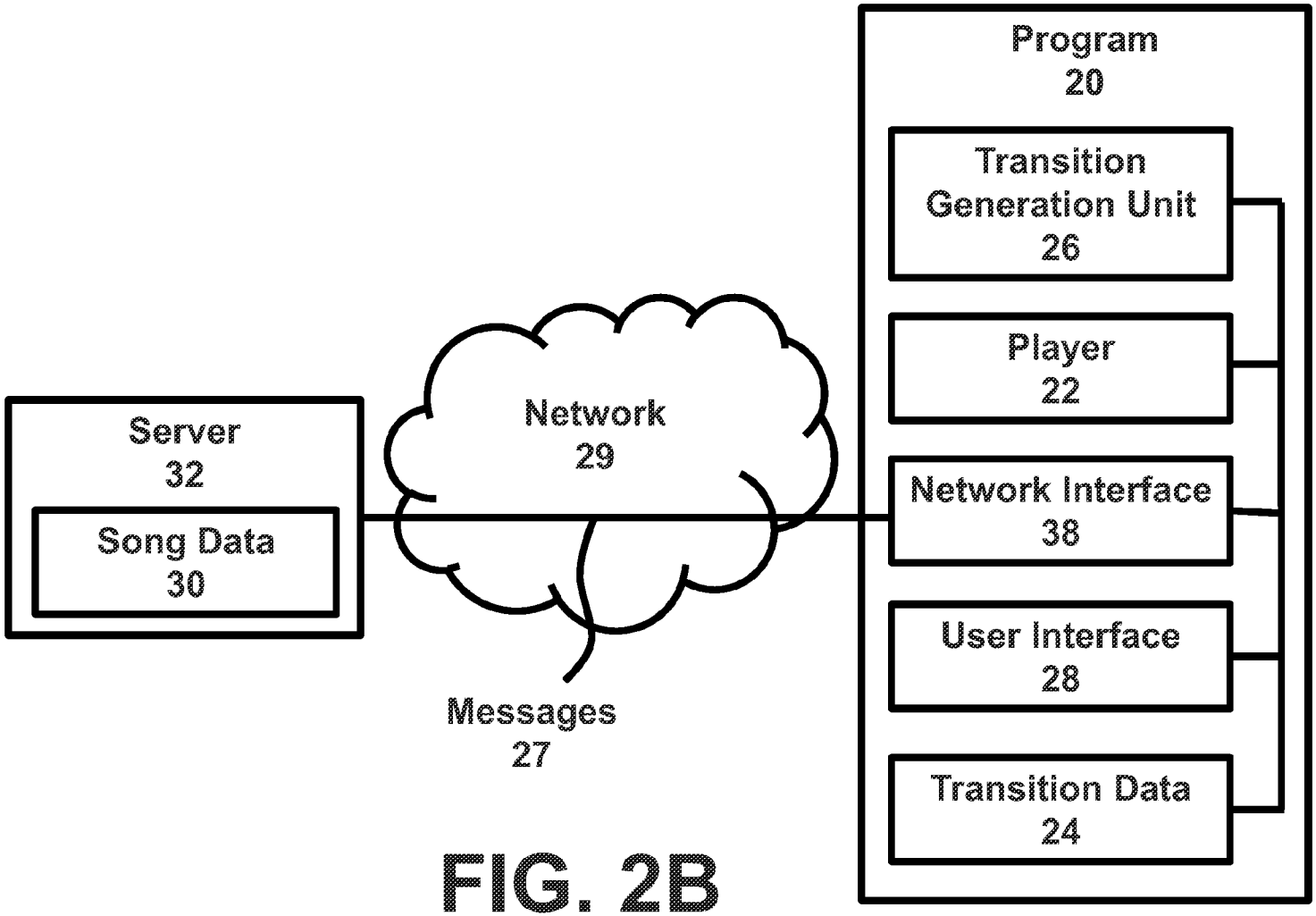

FIG. 2B shows another exemplary embodiment where the song data 30 is stored on the server 32, but the transition data 24 is stored with the program 20. Such an embodiment might be useful in conjunction with "streaming" music services that stream songs to users. The program 20 might take such song data 30 from a streaming music provider and use locally stored transition data 24 and the transition generation unit 26 to produce a transition 50.

Alternatively, the server 32 might stream in one file certain parts of the song data 30 relating to sections of a song that might be used in generating a transition (e.g., this might be a song chosen by the user via the user interface 28). This would enable the program 20 to get the data it might need for generating a transition in just one URL request to the server 32, as well as possibly economizing on the amount of data that the program 20 receives over the network 29. The server 32 might select what portions to stream based on information that the program 20 first provides. This procedure could also extend to multiple songs that the user may wish to play or mix; relevant parts of the songs rather than the whole songs might then be received in one download.

Figure 2C:
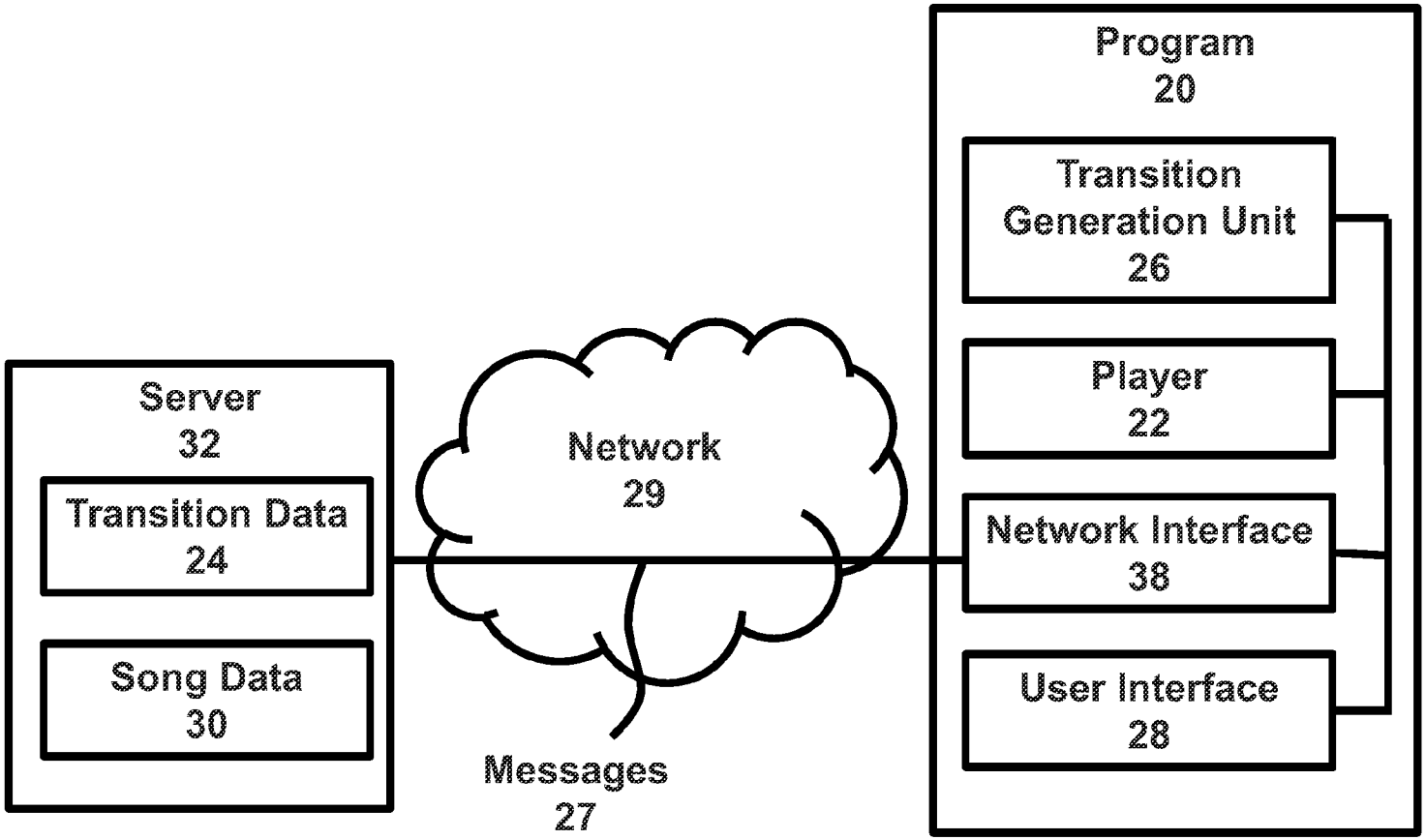

Of course, many other variations are possible. FIG. 2C shows another exemplary embodiment where both the song data 30 and the transition data 24 are stored with the server 32 and then streamed to the program 20 via the messages 27. The program 20 may then use the unit 26 to produce the transition 50.

Figure 2D:
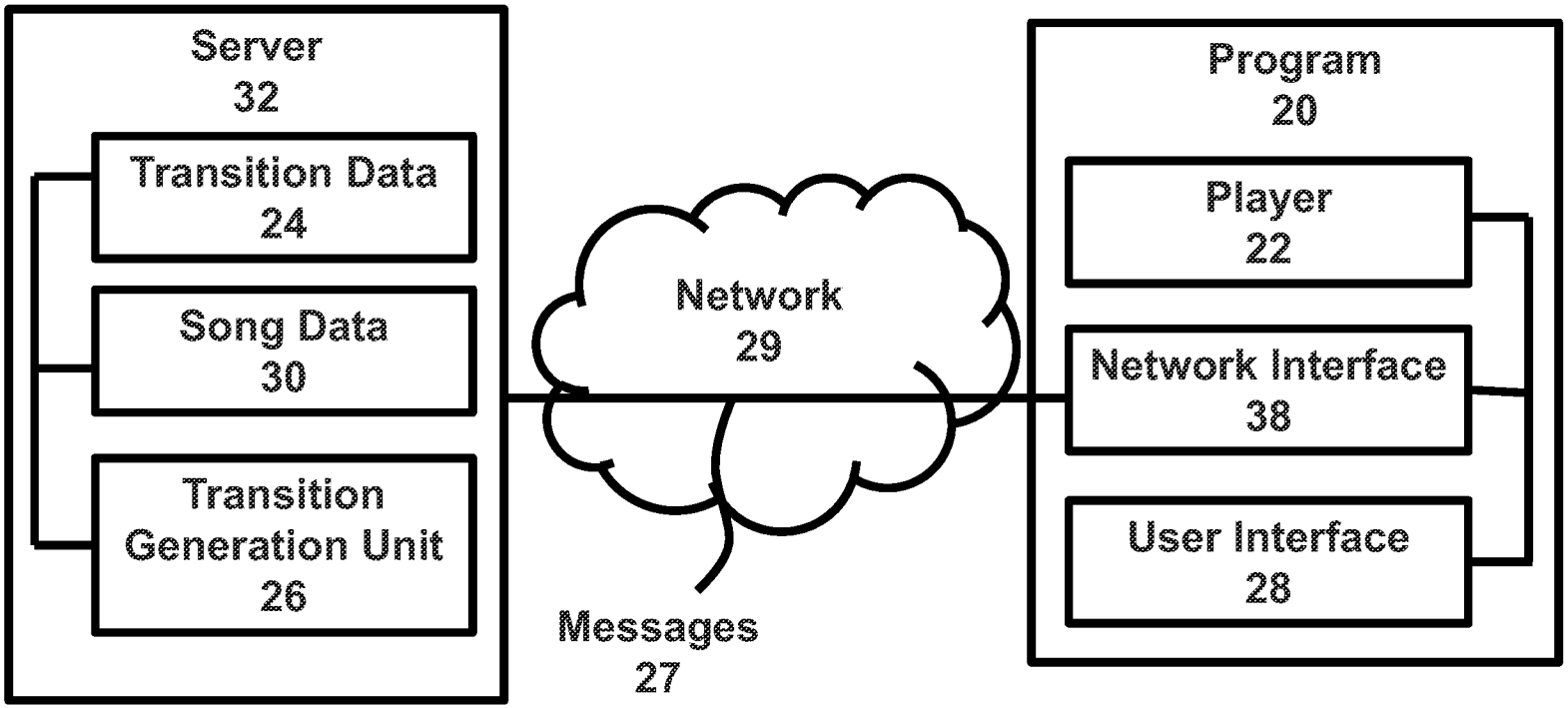

FIG. 2D is yet another exemplary embodiment where the song data 30, the transition data 24 and the unit 26 are all stored on the server 32. In such an embodiment, the server 32 might produce one or more transitions 50, which it would then stream along with the song data 30 via the messages 27 to the program 20 for playback.

Figure 2E:
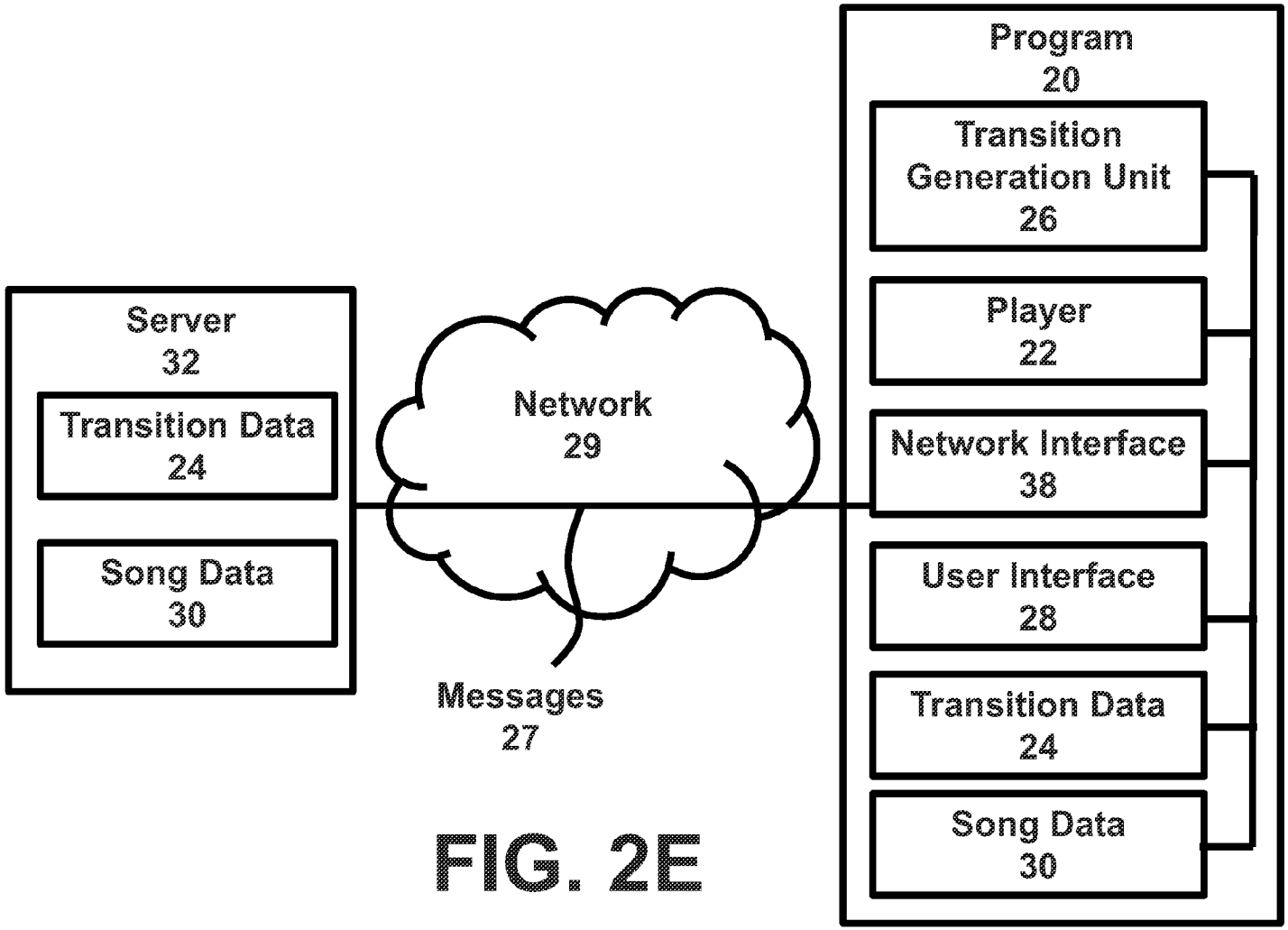

FIG. 2E shows one more exemplary embodiment with the song data 30 distributed between a storage device on the program 20 and a storage device on the server 32. It might be that the program 20 has certain song data 30 (e.g. songs in a collection) while the server 32 may have different song data 30 (e.g. other songs in a separate collection). The song data 30 might then be streamed (e.g. uploaded, downloaded, shared) between the program 20 and server 32 via the messages 27. Such an embodiment might be useful if the song data 30 is to be played on a web-based program 20 and player 22.

When transferred over the network 29, it might also be possible to obfuscate or encode the song data 30 and/or transition data 24 in any number of different ways. For example, the server 32, program 20, or some other device or program might reorder portions of the song data 30 based on a fundamental unit. For example, the server 32 might reorder eighth note segments of the song data 30 when delivering it to the program 20. This might make the song data 30 sound different from the actual underlying song, which might render it unlistenable without a decoder that unscrambles the song data 30.

This scrambling/unscrambling might be done on the level of a frame—for example, the entity delivering the song data 30 (e.g., the server 32) might store a secret seed integer that is used to randomize the order of frames in the song data 30. The entity receiving the song data 30 (e.g., the program 20), which might be reordering frames anyway to generate a transition 50, might also use the secret seed integer to reconstruct the original order of frames in the song data 30.

Various degrees of scrambling/unscrambling could also be used, based on the application desired. For example, the song data 30 could be minimally reordered to sound slightly inaccurate when played, but the reordering may not be so serious as to prevent the song data 30 from being able to be coded into a compressed format, such as MP3.

A similar use of secret keys or other obfuscation methods could also be used on the transition data 24, which could render it useless unless it is descrambled. This might help prevent the transition data 24 (e.g., the cuepoints 40) from being intercepted and stolen when it is transferred over the network 29.

A simple form of obfuscation might relate to delivering transition data 24 only for particular, non-standard versions of the song data 30. For example, the server 32 might only deliver "pre-elongated" song data 30 to the program 20. Such song data 30 might, for example, involve time-stretching the song data 30 such that they have more frames (e.g., are slower) than the underlying songs.

A reason to do this might relate to computational and accuracy limitations in time-stretching songs—since it is often easier and less computationally intensive to compress songs (which involves removing frames) rather than elongate songs (which involves adding frames), the server 32 might pre-elongate the song data 30 using a high quality computing system. The extent to which the song data 30 is pre-elongated might be based, for example, on the song with the highest beats-per-minute (BPM) count in the song data 30.

The server 32 may then deliver the pre-elongated versions of the song data 30 to the program 20, which may then perform the computationally-simpler operation of compressing the song data 30 as appropriate when playing the songs or generating a transition 50. So by delivering a pre-elongated version of a song, one might be able to deliver a higher quality song that will be less susceptible to audio degradation when it is later contracted.

If pre-elongated versions of songs are being transmitted as the song data 30, the program 20 would likely rely on transition data 24 (including cuepoints 40) that has been determined based on the pre-elongated versions of the songs. This might act as a simple form of obfuscation for the transition data 24—since the cuepoints 40 are for pre-elongated versions of the songs, the cuepoints 40 might not be useful if standard versions of the songs are used.

It should be understood that the preceding embodiments are not meant to be limiting, and are intended to merely provide exemplary layouts of the components between a server 32 and a program 20.

FIG. 3A-3D—Exemplary Embodiments for Selecting and Mixing Song Data

Figure 3A:
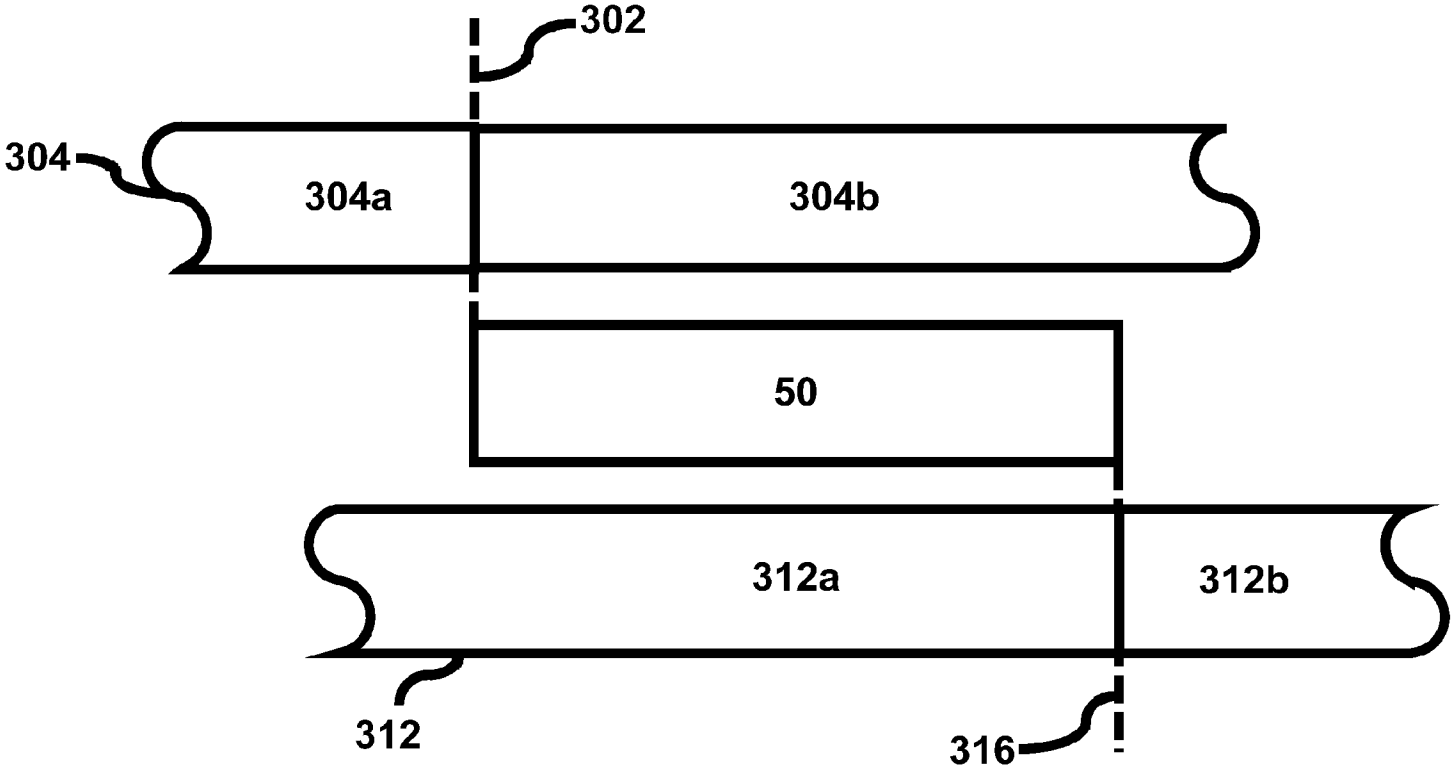
FIGS. 3A-3D are time diagrams illustrating exemplary embodiments of selecting and mixing song data.

Turning now to FIG. 3A, we see a time diagram showing how an exemplary embodiment of selecting and mixing songs may be executed. For illustrative purposes, most of this discussion is keyed in to the embodiments depicted in FIGS. 1A and 1D. However, any of these steps may be performed on other embodiments, including the alternative embodiments previously described.

FIG. 3A shows a first song 304 that is to be played by the player 22. The portion of the song 304 that has been shown is made up of two frame sequences 304*a* and 304*b*. Associated with the first song 304 are transition data 24, including cuepoints 40 and parameters 48, as shown in FIG. 1D. Here, the cuepoints 40 include a first startpoint 302. The first startpoint 302 might mark the beginning of a measure grouping in the first song 304, though as discussed earlier with the cuepoints 40, this may vary depending on the embodiment. For example, the first startpoint 302 might mark a point that is some pre-specified offset away from the start of a measure grouping.

The program 20 also identifies a second song 312 to be played, where two frame sequences 312*a* and 312*b* of the song 312 are shown here. The first song 304 and/or the second song 312 may be specified by the user, or chosen automatically by the program 20. For example, the user may specify a playlist of songs in the user interface 28 (an exemplary user interface 28 will be described in more detail later in connection with FIGS. 7A-7B). Alternatively, the program 20 may save user preferences from prior playback and automatically enqueue one or more songs to be played after the first song 304. The program 20 might also choose songs to play based on choices of an individual other than the user (perhaps an expert listener connected to the user over a network), who might choose a playlist that includes the first song 304 and/or second song 312 here.

The program 20 may then select a second startpoint 316 for the second song 312. This second startpoint 316 may be one of the cuepoints 40 associated with the transition data 24 for the second song 312. Similar to the first startpoint 304, the second startpoint 316 might be a dominant beat or a marking at the start of a measure grouping in the second song 312, though this may vary according to the embodiment at issue. Moreover, while one second startpoint 316 is depicted in FIGS. 3A-3D, it should be understood that there may be more than one potential second startpoint in other embodiments.

In the present embodiment, the program 20 uses the first startpoint 302 and the second startpoint 316 to determine where to end playback of the first song 304 and where to begin playback of the second song 312. It should be understood that both of these might vary in different embodiments (e.g., playback may start or end at some other point as determined by the program 20).

The program 20 may generate a transition 50 to be played in between the two songs 304, 312. In one embodiment, this transition 50 may be a simple pre-made segment that does not rely on any of the parameters 48 or other cuepoints 40 of the two songs. In another embodiment, the transition 50 might be a volume cross-fade (e.g., fading out the first song 304 while increasing the volume of the second song 312).

Another transition 50 would involve the transition generation unit 26, which could use parameters 48 from the first song 304 and/or the second song 312 to generate a transition 50, as depicted in FIGS. 1D. For example, a transition 50 might involve adjusting the duration of and/or time-shifting the first song 304 and the second song 312 in order to align a dominant beat pattern for the first song 304 with a dominant beat pattern for the next song 312. Examples of such a transition are discussed in more detail below, in connection with FIGS. 4A-4G and FIGS. 5A-5G.

Figure 3B:
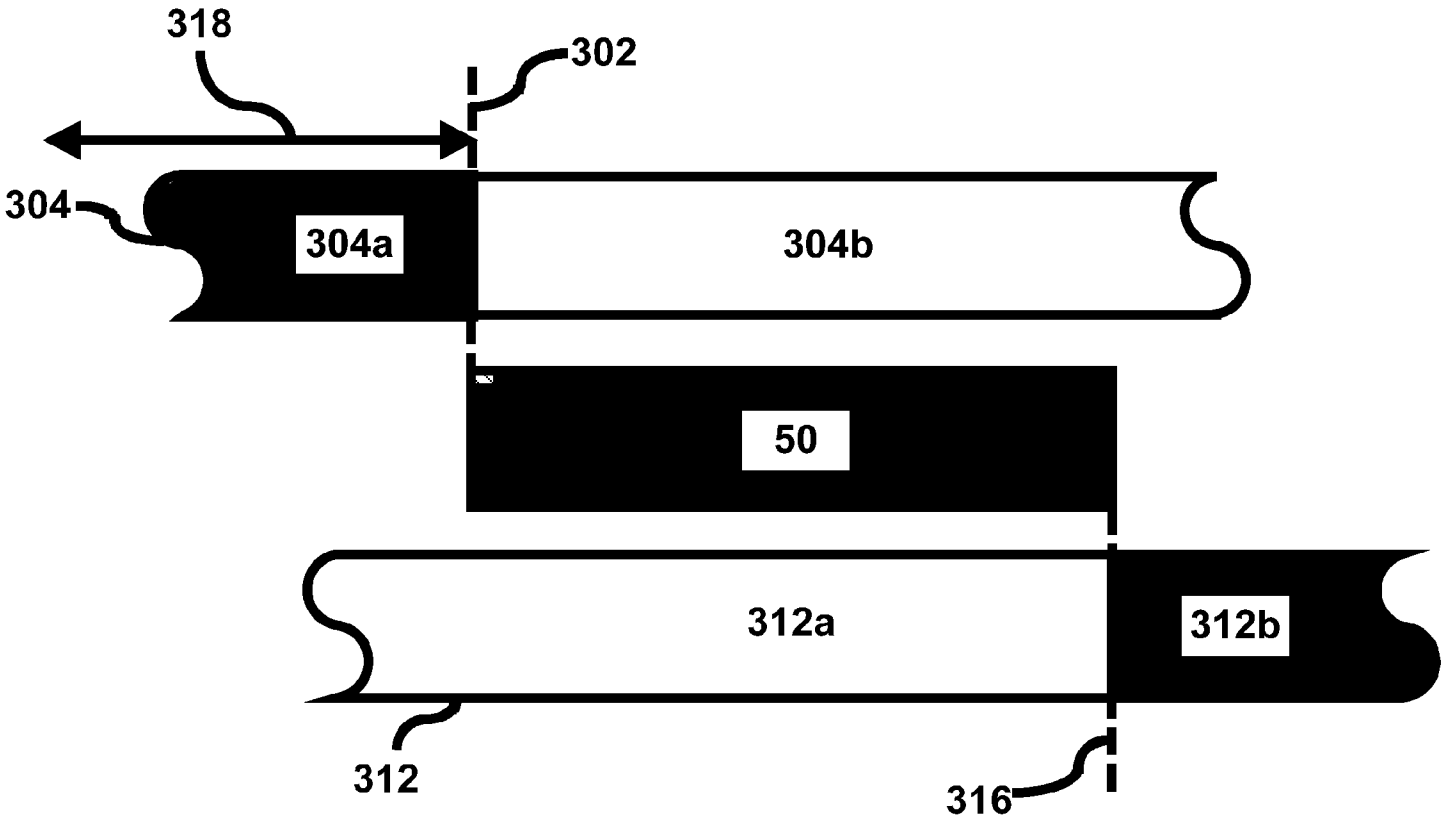

Regardless of how the transition 50 is generated and what song data 30 it contains, FIG. 3B illustrates an exemplary embodiment how the program 20 may execute a switch from the first song 304 to the second song 312 using the transition 50. The hatch pattern indicates the sequence of data being played back by the player 22, where the data might be sent to a buffer, such as the playback buffer 23. As illustrated in FIG. 3B, a playhead (not shown) for the player 22 would first play the data from frame sequence 304*a* of the first song 304. The playhead would then play the transition 50, and finally the data from frame sequence 312*b* of the second song 312. These frame sequences 304*a*, 312*b*, and other frame sequences or subsequences, might be chosen by the transition generation unit 26 and/or one of its components, such as the sequencer unit 36.

As used throughout this specification, "frame sequence" (such as frame sequences 304*a*, 312*b* mentioned above) should be understood as general terms that encompass any sequence of consecutive or non-consecutive frames taken from one or more songs. Here, the frame sequence 304*a* is shown as a sequence of consecutive frames taken from the portion of the first song 304 prior to the first startpoint 302. This portion of the song may, but need not be, a measure grouping. A frame sequence may sometimes contain just a subset of the frames in a measure grouping. Moreover, as discussed in more detail below in connection with FIGS. 5A-5G, a frame sequence may be comprised of subsequences, which in turn may include frames from other measure groupings in the same song, or frames from other songs.

Returning to our discussion on how a transition between the first song 304 and the second song 312 might occur, FIG. 3B shows the program 20 receiving an advance signal 318. This signal 318 may be generated by the user via the user interface 28. Such an embodiment will be discussed in more detail in connection with an exemplary user interface 28 as shown in FIGS. 7A-7B.

Alternatively, the advance signal 318 may be produced by the program 20, perhaps in response to the status of playback of the first song 304. For example, as the first song 304 nears its end—a fact that may be captured by the fact that the playhead has passed one of the final cuepoints 40 for the first song 304—the program 20 may initiate a transition to the second song 312. Such a process will entail either creating or using a pre-made transition 50 to fill the gap between the first startpoint 302 and the second startpoint 316.

In yet another embodiment, the advance signal 318 may be triggered based on a playback mode selected by the user. For example, if the user wishes to cycle through songs quickly or preview songs in a playlist, he or she may select a "quick transition" mode that will automatically move from a currently playing song (e.g., the first song 304) to a next song in the playlist (e.g., the second song 312) after a certain amount of time. This amount of time may be a set number (e.g., "transition to the new song after 30 seconds") or it might depend on the song being played (e.g., "transition to a new song after playback of one measure grouping in the currently playing song").

Alternatively, the program 20 may automatically trigger the advance signal 318 based on what it decides will sound best. For example, the program 20 may determine that a certain measure grouping in the first song 304 sounds particularly good with another measure grouping in the second song 312, so it might switch between these songs 304, 312 such that these measure groupings are part of the transition 50.

More generally, the program 20 may match portions of any songs specified in a playlist or list of songs that the user has, and switch between them according to a determination by the program 20 as to what transitions will sound best. Alternatively, the program 20 may merely recommend which transitions it believes will sound good but leave it to the user to initiate the transition (e.g., by requiring the user to push an advance button on the user interface 28). How the program 20 may utilize user feedback/information and/or automated mechanisms to make these determinations and recommendations is discussed in more detail below.

Figure 3C:
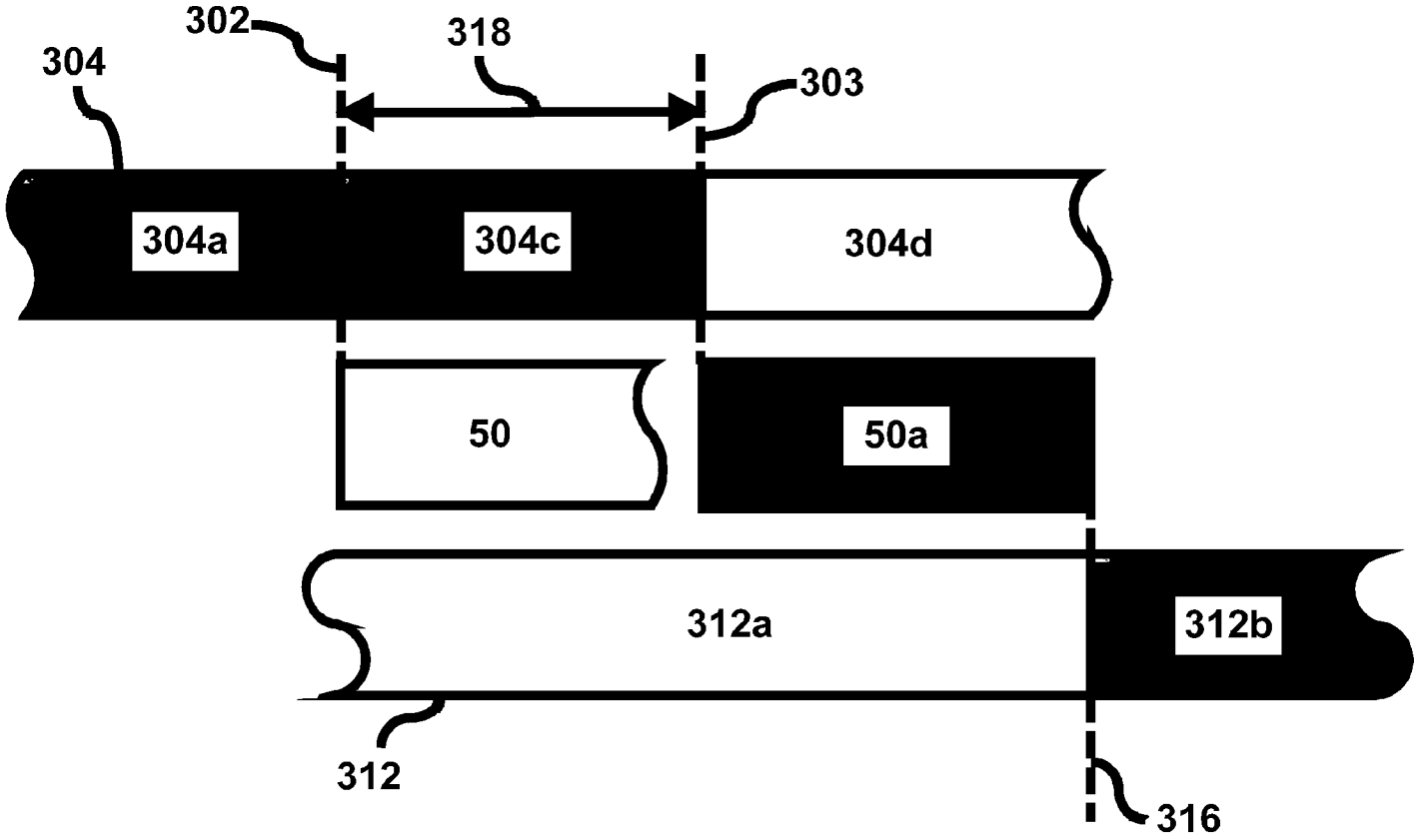

FIG. 3C illustrates another playback scenario. As depicted, the first song 304 has at least two first startpoints 302 and 303. In this scenario, the program 20 receives the advance signal 318 after the playhead has passed the frame associated with the first startpoint 302 but before playback of the frame associated with the first startpoint 303. The program 20 therefore generates a transition based on the first startpoint 302, since the advance signal 318 was received after first startpoint 302 had already passed. The player 22 then plays the transition 50 and subsequently the next song 312 beginning at the second startpoint 316. We see from the hatch pattern in FIG. 3C that frame sequences 304*a*, 304*c* of the first song 304 are sent first to the playback buffer, followed by transition 50*a*, and then frame sequence 312*b* of the second song 312.

Figure 3D:
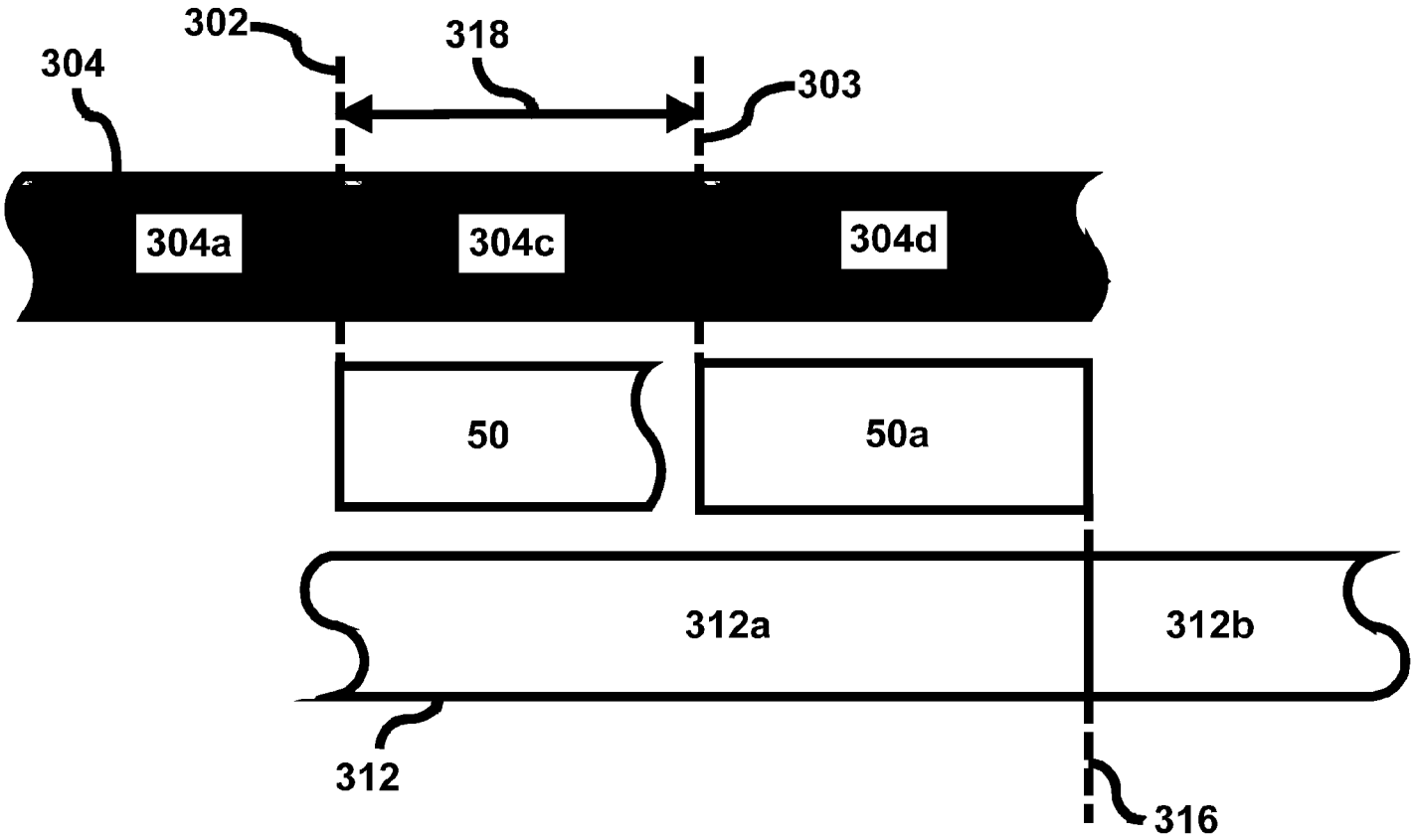

FIG. 3D illustrates a scenario where the program 20 does not receive any advance signal (so there is no advance signal 318) prior to playback of the first startpoint 303. In such a scenario, the player 22 may continue playing the first song 304 until it terminates, or until an advance signal is received and another first startpoint is reached in the song (not shown in the diagram here). The player 22 may then play a transition and proceed to start playing the second song 312 at a second startpoint, which might be second startpoint 316 or some other point not pictured here.

It should be understood that in many embodiments, a number of factors may be used to determine the sequence of playback of the first song 304, the transition 50, and the second song 312. For example, the program 20 (or one of its components, such as the transition generation unit 26 or, if there is one, the cuepoint selection unit 35) may determine a ranking that prioritizes the one or more cuepoints in the first song in terms of which cuepoints might be better as a place to start a transition. Such a priority ranking may depend on playhead position, and the program 20 may update the ranking as the playhead advances. For example, the cuepoints that rank highest might be those that have a frame number greater than the frame number associated with the playhead (since those cuepoints have yet to be reached by the playhead). In particular, the next cuepoint that the playhead will hit (e.g., the cuepoint with the lowest frame number greater than the frame number for the playhead) might receive a high rank, since it is the nearest cuepoint to the playhead.

In generating a priority ranking for the first song cuepoints, the program 20 may consider other factors other than position of the playhead and receipt of the advance signal 318. For example, given that time-stretching and generating a transition takes time, the program 20 might consider this latency when selecting a first song cuepoint. This latency might be relevant because if the playhead is sufficiently close to the next cuepoint it will reach, there may not be enough time to generate the transition 50 for playback if one has not been generated yet. The program 20 may then prioritize a later cuepoint as a preferred cuepoint in the first song. Alternatively, the program 20 might address this latency problem by pre-rendering transitions for one or more of the cuepoints in the first song, so that they are more quickly available for playback.

The program 20 may choose among cuepoints in the second song 312 and/or first song 304 based on other factors as well. For example, a signal from the user or from a component within the program 20 may affect which transition is generated by the program 20. A program signal may be, for example, a status of the program window on the user interface 28, a timeout signal, a central processing unit load signal, and a memory signal.

To illustrate, if a user window has been minimized, this might be a sign that the user is unlikely to trigger an advance button on the user interface 28, perhaps making it less likely that the advance signal 318 is forthcoming. So instead of expending resources preparing transitions for all cuepoints in the first song 304 (on the theory that the user might trigger the advance signal 318 at any moment), it might make more sense for the program 20 to prepare a transition for just the last cuepoint in the first song 304, since it is likely that the first song 304 will play out until that point. Indeed, it might make sense for the program 20 to prepare this transition first as a matter of course, such that a beat-matched transition between the first song 304 and the second song 312 is assured.

Other signals might instruct the program 20 to change which transitions it is rendering and how. For example, a timeout signal might indicate that a process is taking longer than a set amount of time, suggesting that the program 20 should not try to generate more transitions. Similarly, a central processing load signal, which might indicate whether the CPU is having a difficult time running computations, and a memory signal, which might indicate that a memory unit is running out of space, might also help the program 20 choose which transitions to render (or not to render).

User-generated factors may also affect how the program 20 chooses among cuepoints and decides what to render. For example, the program 20 and/or the server 32 may collect information from users about transitions that sound good between various songs. Some of this might be direct feedback from a user, who might, for example, vote on transitions that he thought sounded good or bad. This feedback may be submitted via the user interface 28. Other user information (e.g., history of transitions played, preferences selected by the user, choice of songs in a playlist, choice of songs purchased, amount of time spent listening to particular songs or songs in a genre, etc.) may also be used to determine optimal transitions.

The program 20 may utilize the user feedback/information from a particular user to customize transitions for that user. For example, the program 20 may know that a particular user enjoys transitions from one particular artist (e.g., Nirvana) to another (e.g., Nine Inch Nails), and dislikes one particular transition involving a certain measure grouping in the first song 304 and another measure grouping in the second song 312.

Additionally, or alternatively, the program 20 may aggregate user information to determine default cuepoint choices. For example, based on user feedback and/or other information gathered from users, the program 20 might determine that one particular transition between the first song 304 and the second song 312 sounds particularly good to most users, and that most songs from two particular artists do not sound good when combined.

Additionally, the program 20 might use some kind of automated mechanism to determine which transitions sound good to users. One way to do this might be to use particular sonic attributes of songs in order to determine if they would sound good when mixed together. For example, the program 20 and/or server 32 might calculate a volume envelope for songs in the song data 30. This volume envelope may, for example, measure the amplitude or energy of different frequencies or frequency bands in the songs. Based on these values, it might be determined that certain songs are more likely to sound better than others when combined.

For example, suppose the program 20 is trying to mix a frame sequence beginning with the first startpoint 302 with some portion of the second song 312. The program 20 might consider the volume envelope of that frame sequence, either by analysis or by loading values for an analysis that was done previously. Suppose this frame sequence has a high volume in high-range and low-range frequencies, but has a low volume in the mid-range frequencies. When choosing a second song startpoint from among the cuepoints 40 in the second song 312, the program 20 might seek out one of the cuepoints 40 that corresponds to a portion of the second song 312 with a high volume in the mid-range frequencies and a low volume elsewhere. If this portion of the second song 312 is combined with the frame sequence, the resulting transition 50 may have a more even volume across frequency levels. This might be pleasing to the ears and hence, might be a better portion of the second song 312 to choose for mixing.

FIG. 4A-4G—Exemplary Embodiments for Generating a Transition

Figure 4A:
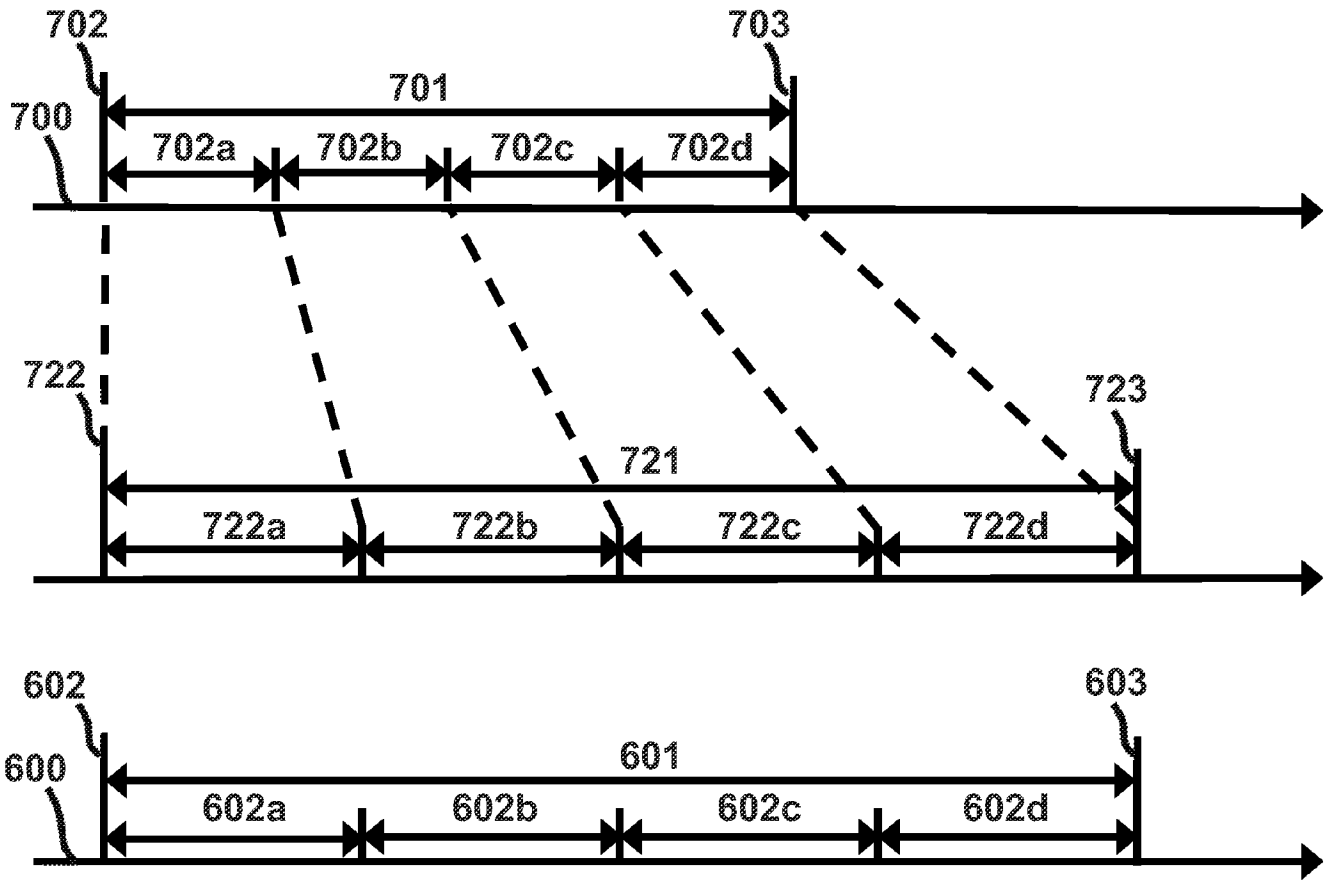
FIGS. 4A-4G are time diagrams illustrating exemplary embodiments for generating a transition between songs at the measure level.

Turning now to FIG. 4A, we see how a transition (such as transition 50 or transition 50*a* in FIGS. 3A-3D) might be generated. FIG. 4A shows a first song 700, with a measure 701 having a measure startpoint 702 and a measure endpoint 703. The measure 701 has been divided into four equal subsequences 702*a*, 702*b*, 702*c*, 702*d*.

The start and end points of each of these subsequences corresponds to a beat in the song 700. A measure like measure 701 is typically described as having four beats (you count either the measure startpoint 702 or the measure endpoint 703, in addition to the three beats within the measure). It should be understood that in other embodiments, measures might not be divided into equal subsequences, beats might not be equally spaced in a measure, and a measure might have more or less than four beats. It should also be understood that subsequences (such as the subsequences 702*a*, 702*b*, 702*c*, 702*d*) may sometimes be colloquially be referred to as beats, rather than the start and end points of these subsequences being called beats.

FIG. 4A also shows a second song 600, with a measure 601 having a measure startpoint 602 and a measure endpoint 603. The measure 601 also has four beats and four corresponding subsequences, 602*a*, 602*b*, 602*c*, 602*d*.

As FIG. 4A shows, measure 701 of the first song 700 can be time-stretched into a time-stretched measure 721, with time-stretched measure startpoint 722 and time-stretched measure endpoint 723. Time-stretched measure 721 has time-stretched subsequences 722*a*, 722*b*, 722*c*, 722*d* that match the length of the subsequences 602*a*, 602*b*, 602*c*, 602*d*, respectively, of the measure 601 in the second song 600. In an alternative embodiment, the entire first song 700 may be time-stretched instead of just the measure 701.

The time-stretching performed here might be done by the transition generation unit 26. Alternatively, the time-stretching might be done on a server (such as the server 32 in FIGS. 2A-2E), with the time-stretched measure 721 being delivered via messages 27 over the network 29 to the computer system running the program 20.

Time-stretching generally implies that the number of frames in a song has been increased or decreased while the underlying sound of the song remains the same. For example, if a segment of a song is time-stretched by removing frames from the segment, it might sound as if it has been sped up. If a segment of a song is time-stretched by adding frames to the segment, it might sound as if it has been slowed down. The pitch of the segment (e.g. musical key) might also change when a song is time-stretched, though sound stretch libraries that preserve pitch during time-stretching operations might also be used.

Since in the present embodiment, the second song subsequences 602*a*, 602*b*, 602*c*, 602*d* are longer than their corresponding first song subsequences 702*a*, 702*b*, 702*c*, 702*d*, this implies that the transition generation unit 26 (or server 32, if that does the time-stretching) has added frames to generate time-stretched subsequences 722*a*, 722*b*, 722*c*, 722*d*, which have substantially the same number of frames as the second song subsequences 602*a*, 602*b*, 602*c*, 602*d*, respectively.

As an alternative to time-stretching, subsequences 702*a*, 702*b*, 702*c*, 702*d* could be changed into subsequences 722*a*, 722*b*, 722*c*, 722*d* by simply adding some extra frames and not performing a typical time-stretching operation. These extra frames may be arbitrary—for example, they might be silent frames (e.g., with a frame value of 0), they could be other frames from some portion of the song 700, or they may be frames received from some external song.

Figure 4B:
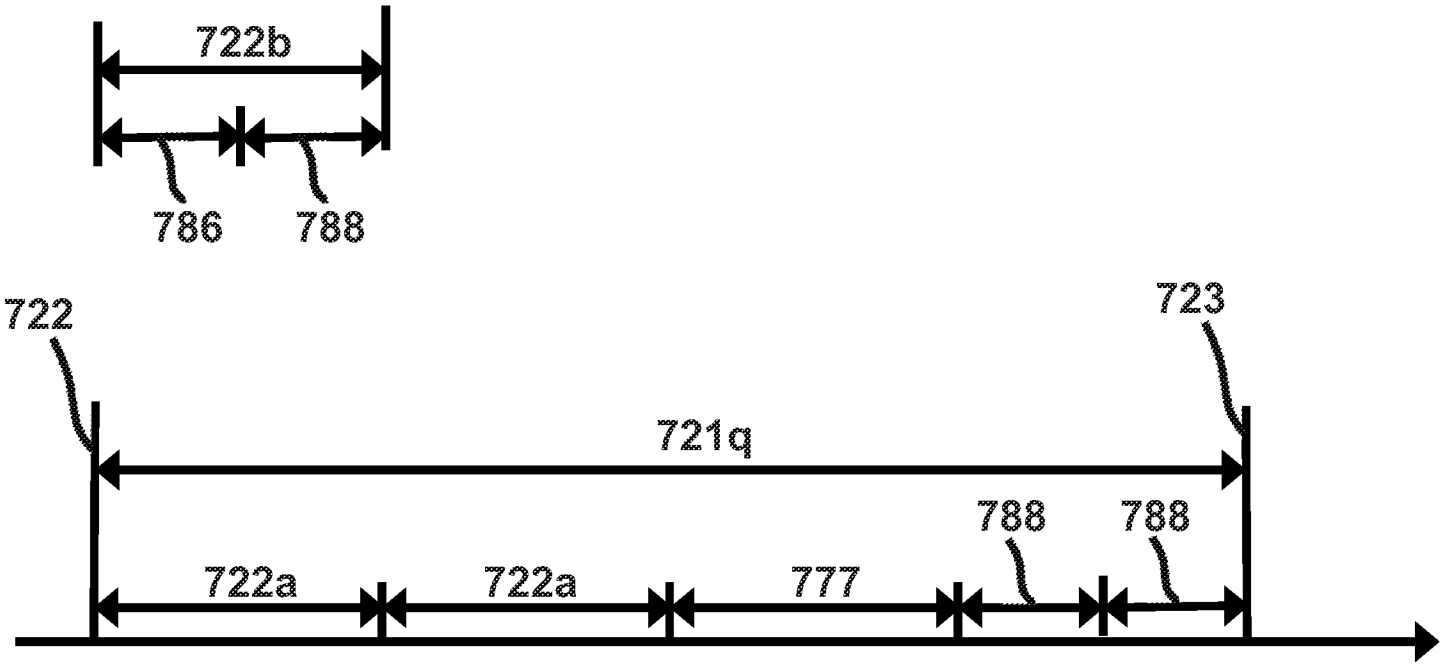

Turning to FIG. 4B, we see a variation of the previous embodiment. At the bottom, we see time-stretched measure 721*q*, which is a variation of the time-stretched measure 721 shown in FIG. 4A. Although both time-stretched measure 721 and time-stretched measure 721*q* share the same startpoint 722 and endpoint 723, subsequences within the measure 721 have been changed, replaced, or looped by the program 20 to create measure 721*q*.

For example, in place of subsequence 722*b* in measure 721, we see that subsequence 722*a* has been placed in measure 721*q*. This will generate a "loop" effect at the level of a subsequence, as subsequence 722*a* will now play twice in a row if this measure is played.

We also see that subsequence 722*c* in measure 721 has been replaced by subsequence 777 in measure 721*q*. Subsequence 777 might be a set of external frame values, such as another portion of the first song 700 (before or after it has been time-stretched), a portion of the second song 600, or some other piece of song data 30 altogether. For example, subsequence 777 might comprise some kind of external sound (e.g., a ring of a bell, a portion of another song, a percussive element). This example shows how the program 20 might replace subsequences, parts of subsequences, or individual frames of a song by external frames (e.g., frames from outside the particular subsequence or measure being altered).

Additionally, FIG. 4B shows that subsequence 722*b* (which was introduced in FIG. 4A as the second subsequence in the time-stretched measure 721) is comprised of two frame segments, 786 and 788. In measure 721*q*, instead of using subsequence 722*d* (which was used in measure 721), the second frame segment 788 is repeated twice. This will cause whatever sound is represented by part 788 to be played twice in a row at the end of playback of measure 721*q*. So we see how a subsequence may be partitioned into smaller frame segments, which may be looped or altered similar to subsequences.

This example illustrates how the program 20 might partition a subsequence into smaller frame segments and then operate on those frame segments. For example, the program 20 may divide a subsequence into an even number of frame segments, and then loop one or more of those frame segments.

In some embodiments, it might be advantageous to loop frame segments that are at the beginning or the end of a frame sequence, because these might be desirable parts of a song to repeat or otherwise mix. For example, the first measure following a cuepoint (e.g., first measure in a measure grouping) might have a larger or more recognizable downbeat than other measures, so it might be a better measure to loop. Alternatively, for a next song to be played (e.g., the second song 600 here), the last measure in a measure grouping that is used in a transition will have aural continuity with the rest of the song, which will be played following the transition. Accordingly, looping this segment may also be desirable.

These examples should illustrate that different embodiments of the program 20 might perform any number of different operations on frame sequences and subsequences (including segments within subsequences). For example, the program 20 may change the number of frames (which may involve time-stretching) of any subsequence or set of subsequences. It might reorder the frames within a subsequence (e.g., reverse the order of frames), or change the order of subsequences. The program 20 might repeat portions of a subsequence to generate a loop within a subsequence, or repeat subsequences to generate a loop effect at the subsequence level. Or the program 20 might replace one or more of the frame values in a subsequence with an external frame value, which might come from the same song as the subsequence or from some other song data 30.

It should be understood that this list is not exhaustive, as the program 20 might do other things in other embodiments. For example, the program 20 might add an offset to any given subsequence by prepending it to the beginning or appending it to the end of the subsequence. This which might extend the length of the subsequence and whatever measure might contain the subsequence. This offset may, for example, be another portion of a song that begins on one beat and ends on another beat.

Although the operations are shown as being performed on the time-stretched measure 721 of the first song to generate measure 721*q*, it should be understood that these operations may be performed on time-stretched or non-time-stretched versions of any song. For example, in an alternate embodiment, the program 20 may add an offset or reorder frames of the measure 601 of the second song 600, or loop subsequences in measure 701 of the first song 700.

Moreover, in an exemplary embodiment, the user interface 28 may permit a user to select between various transition modes that determine how the program 20 operates on frame sequences and subsequences. For example, each transition mode might specify a different generic mapping between subsequences or frames in a first song (e.g., a currently playing song, like the first song 700 here) and a second song (e.g., a next song to be played, like the second song 600 here). The program 20 may then apply the generic mapping to map one or more of the subsequences in the currently playing song to one or more subsequences in the song to be played next. For example, in the embodiment shown in FIG. 4B, a transition mode may apply a subsequence mapping that specifies the order of subsequences in the time-stretched measure 721*q*. The mode may additionally, or alternatively, specify a frame mapping for frames within any particular subsequence.

Figure 4C:
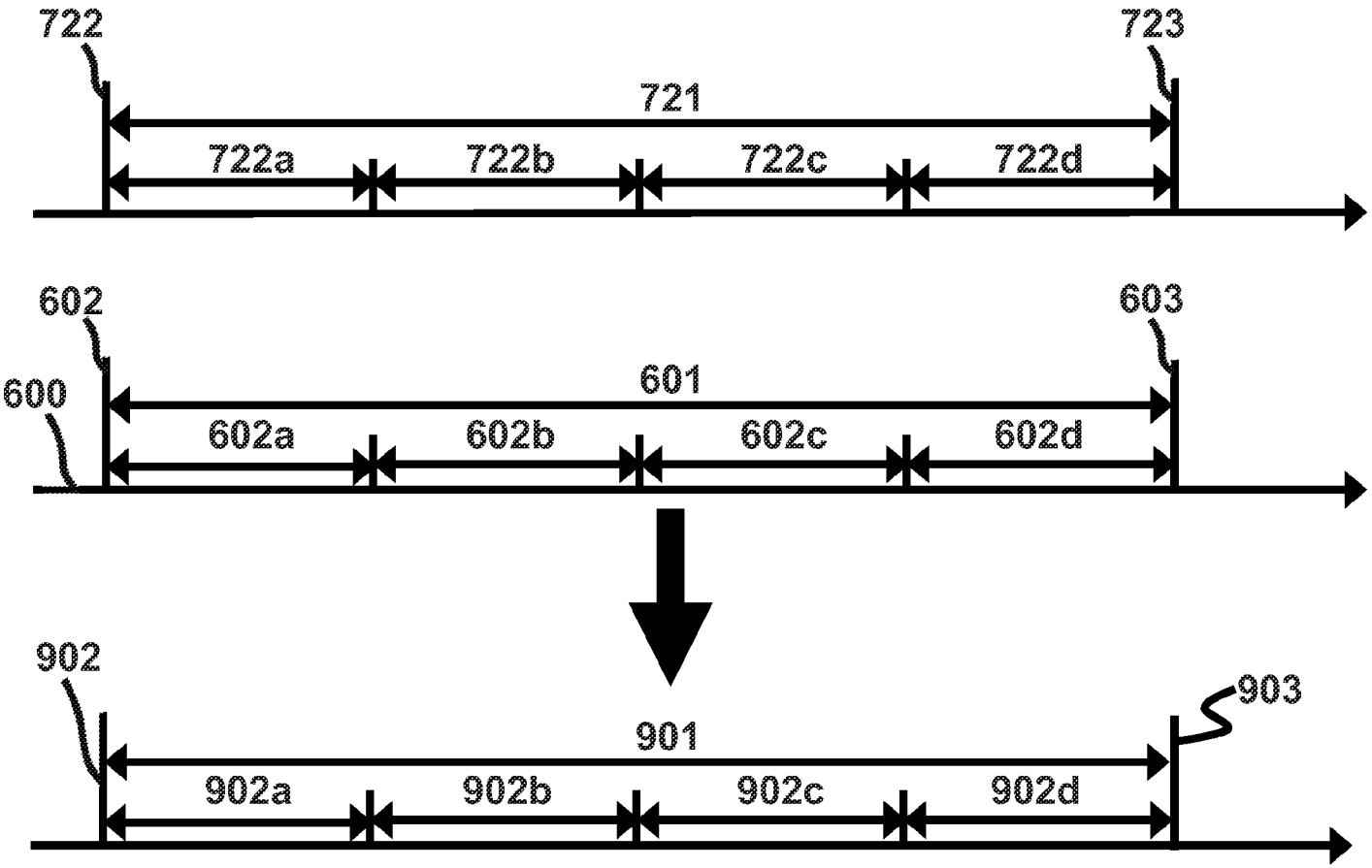

Turning now to FIG. 4C, we see how a transition may be generated from the time-stretched measure 721 and the measure 601 from the second song 600. It should be understood that any other pair of measures (e.g., time-stretched measure 721*q* and the measure 601) might be used instead to get a different transition.

In FIG. 4C, we see that frame values from measures 721 and 601 may be combined to generate a transition measure 901, with transition measure subsequences 902*a*, 902*b*, 902*c*, 902*d*. In a simple embodiment, combining frame values may involve merely adding the frame values of one song to another song. This, or other forms of combination, might be accomplished by the transition generation unit 26 and/or one of its component (such as the combiner unit 37).

For example, here we have two measures (the time-stretched measure 721 and the second song measure 601) that are aligned along measure boundaries (measure boundary 722 aligns with measure boundary 602, and measure boundary 723 aligns with measure boundary 603). The measures 721, 601 are also aligned along beats (e.g., frame subsequences 722*a*, 722*b*, 722*c*, 722*d*, have substantially the same number of frames as subsequences 600*a*, 600*b*, 600*c*, 600*d*, respectively).

The program 20 may form the transition measure 901 by simply adding frame values for corresponding frames in the two measures 721, 601, such that the frame value for the measure boundary 722 adds together with the frame value for the measure boundary 602, and frame values for subsequent frames in the time-stretched measure 721 add together with frame values for subsequent frames in the measure 601.

It should be noted here that songs do not need to be perfectly aligned for them to be combined in this manner. For example, the time-stretched measure 721 might merely be substantially aligned with the second song measure 601, with subsequences 722*a*, 722*b*, 722*c*, 722*d*, merely having substantially the same number of frames as subsequences 600*a*, 600*b*, 600*c*, 600*d*, respectively.

Whether songs are substantially aligned might depend on a number of factors, such as the degree of accuracy desired for the audience at issue. For example, true audiophiles may demand a higher level of accuracy than the average user. One possible test, though not necessarily the only one, for whether sequences or subsequences are substantially aligned would be to see if a listener (e.g., an average listener, an especially keen listener, etc.) can discern any misalignment if the two supposedly aligned songs are combined and played. As noted earlier, a misalignment greater than about 10 milliseconds of song data 30, which corresponds to about 440 frames if the song data 30 is sampled at 44,100 samples per second, might be discernible to some listeners. Other listeners may only respond to a misalignment on the order of about 100 milliseconds of song data 30, which would correspond to about 4400 frames at the 44,100 sampling frequency. It should be understood that these values are exemplary and that a larger degree of misalignment may be acceptable in certain embodiments.

In addition to adding frame values, combining two songs might involve applying any number of filters, effects, overlays, or any other processing to a transition (such as the transition 50 or the transition measure 901). For example, the transition generation unit 26 might filter the transition measure 901 (and/or some part of the first song 700 or the second song 600) prior to it being played. In one embodiment, the unit 26 might apply a band filter (not shown). This filter might alter frame values in different frequency bands of a song based on a desired playback profile. The filter might also determine the relative mix of a playback parameter (e.g., high frequency band volume, mid frequency band volume, low frequency band volume) based on the parameters 48 for the songs being mixed. Similarly, the unit 26 may use some form of volume normalization to ensure that no song being played varies by more than a certain threshold in its volume as compared to other songs being played. Using a filter and/or volume normalization in the present embodiment could help make a transition between songs smoother.

Additionally, the transition generation unit 26 might also shift the pitch of a transition based on the musical keys of the songs at issue. Here, the unit 26 might shift the pitch of the measure 901 based on the musical key of the first song 700 and the second song 600.

Figure 4D:
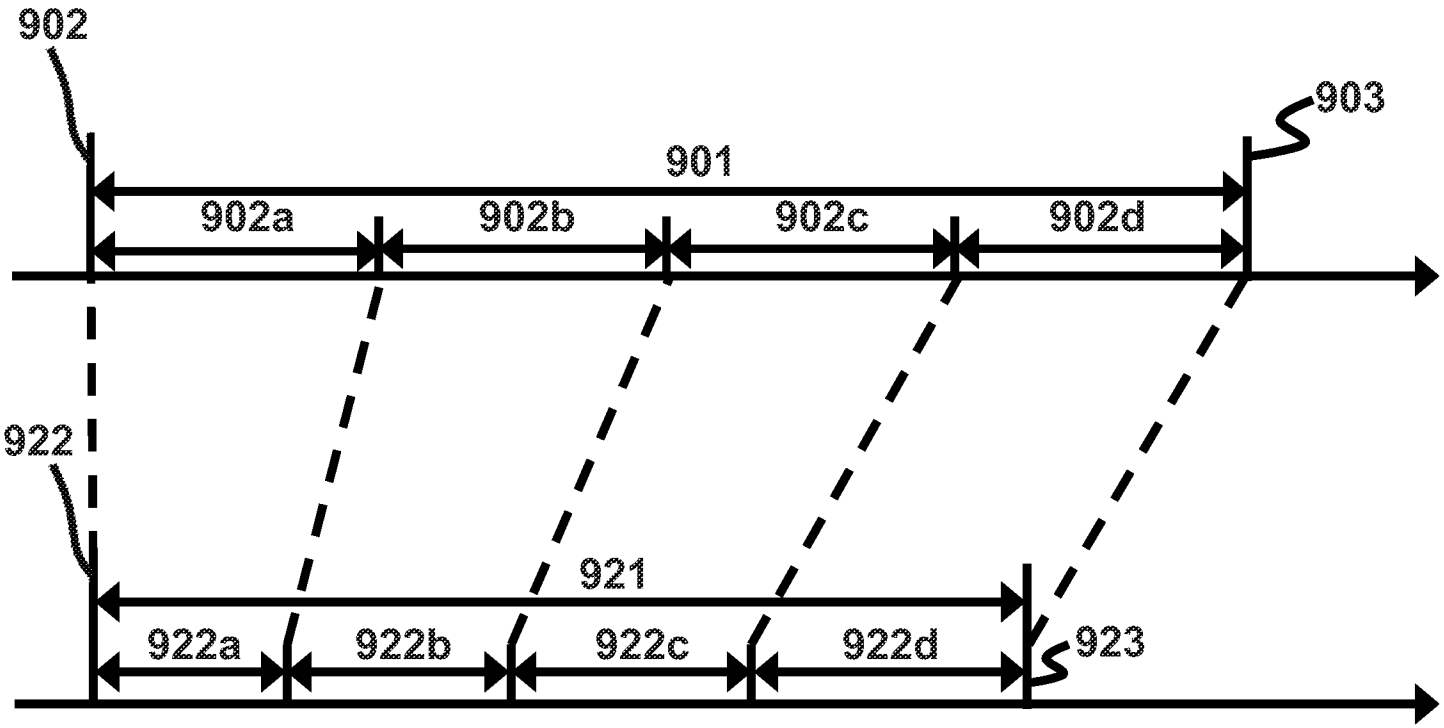

Turning to FIG. 4D, we see how the transition generation unit 26 might alter the tempo of a transition (here, transition measure 901) to generate a smooth change in tempo from the first song 700 to the second song 600. In the present embodiment, such a change would depend on the relative tempos of the songs.

For example, suppose the first song 700 has a tempo of 108 beats-per-minute (BPM), and the second song 600 has a tempo of 100 BPM. Thus, the first song 700 is faster than the second song 600. Since the first song 700 will be played first, followed by the transition measure 901, and then the second song 600 (see the discussion in connection with FIGS. 3A-3D), the program 20 may seek to ensure that the transition measure 901 begins with a tempo close to the first song tempo and ends with a tempo close to the second song tempo. In other words, the program may seek to have the tempo of the transition measure 901 decrease from 108 BPM to 100 BPM as the transition measure 901 is played.

The program 20 might accomplish this, for example, by linearly decreasing the tempo in the transition by 2 BPM for each of the four subsequences in the transition measure 901. To accomplish this linear ramping effect, the transition generation unit 26 may time-stretch the transition measure subsequences 902*a*, 902*b*, 902*c*, 902*d* into final transition measure subsequences 922*a*, 922*b*, 922*c*, 922*d*, respectively, which in total comprise a final transition measure 921.

As is apparent from the diagram, final transition measure subsequence 922*a* is shorter as compared to the other final transition measure subsequences 922*b*, 922*c*, 922*d*, implying that it also has the fastest tempo. This makes sense, since it is the first subsequence to play, and hence its tempo will be closest to that of the first song 700. Conversely, we see that the last of the subsequences, subsequence 922*d*, has the longest length, and hence it has a tempo closest to that of the second song 600.

It should be understood that in other embodiments, the program 20 might choose any arbitrary speed profile in generating the final transition measure 921. For example, the program 20 might speed up the transition rapidly at first and then slow down, or vice-versa. The program 20 also might alter the tempo such that it increases or decreases speed across any single subsequence. Alternatively, the program 20 might not use any ramp at all, in effect playing the transition measure 901 just as it is.

Moreover, it should be noted that the length of the final transition measure 921 need not depend on the tempo of the first song 700, the tempo of the second song 600, the length of the first measure 701, or the length of the second measure 601. Indeed, the length of the final transition measure 921, and the length of any of the final transition measure subsequences 922*a*, 922*b*, 922*c*, 922*d*, might be any arbitrary length. These lengths may depend, for example, on a particular effect that a user wants, or a particular transition mode that a user has selected. For example, if a user wants a transition between the first song 700 and 600 to sound very slow, without any kind of ramping effect, the program 20 could elongate (e.g., using time-stretching) both the first measure 701 and second measure 601 by whatever desired amount, which still ensuring that the subsequences within the measures 701, 601 are aligned as before (so the transition still sounds beat-aligned).

It should also be noted that the present embodiment does not require any time-stretching (or any other operation of adding/removing frames) to be done in any particular order. For example, while the present embodiment described measure 701 in the first song 700 as being time-stretched first (FIG. 4A), then combined with measure 601 of the second song 600 (FIG. 4C) and then time-stretched again to generate a linear ramp (FIG. 4D), this order may be altered.

To illustrate, both measure 701 and measure 601 of the second song 601 may be time-stretched such that subsequences 702*a*, 702*b*, 702*c*, 702*d* and subsequences 602*a*, 602*b*, 602*c*, 602*d* have the same length as final measure subsequences 922*a*, 922*b*, 922*c*, 922*d*, respectively. Then the time-stretched subsequences for the first song 700 and the second song 600 may be combined to generate the same final transition measure 901 as before. Other ways of generating a beat-aligned transition involving the first song 700 and the second song 600 may also be used.

Figure 4E:
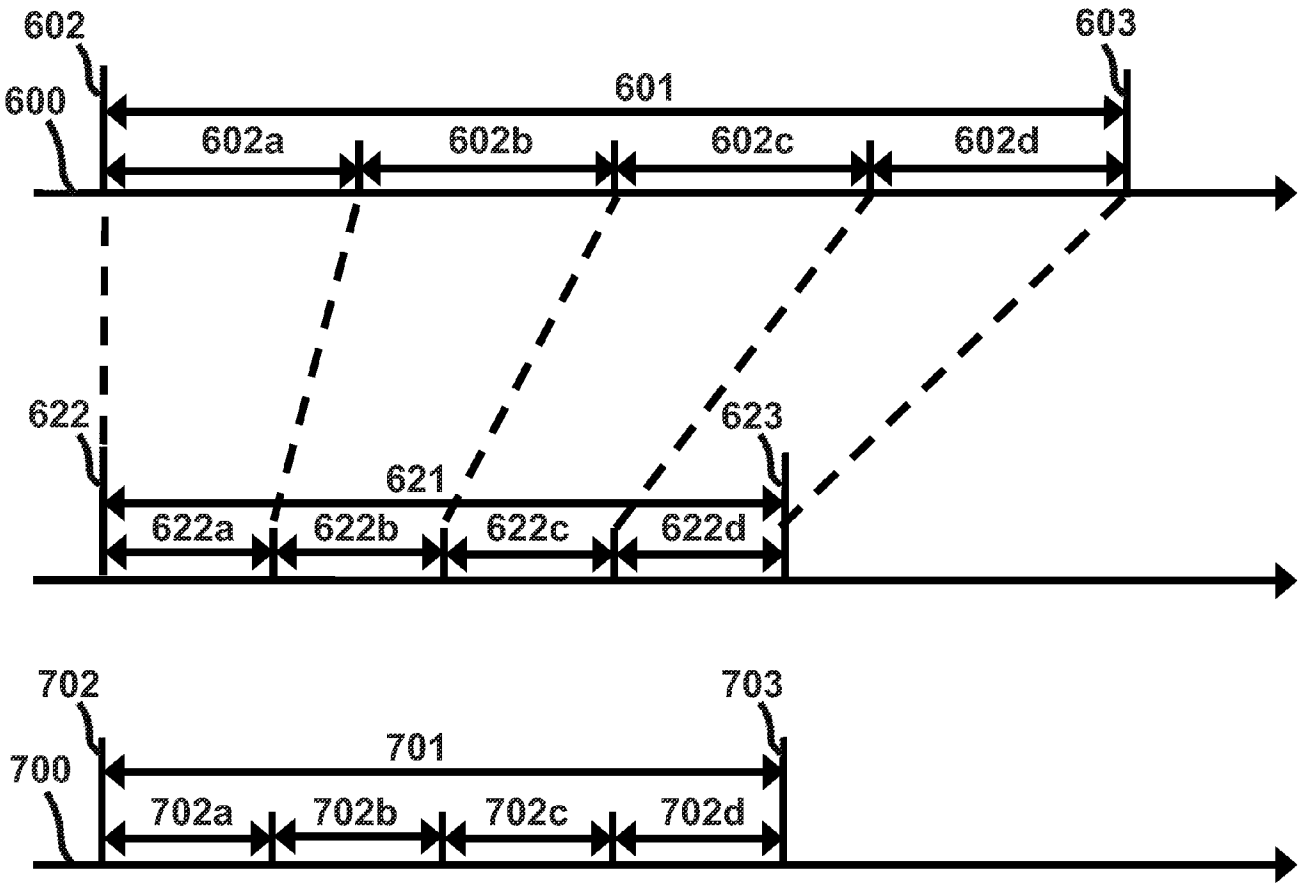

Turning to FIG. 4E, we see the mirror image of what we saw in FIG. 4A—instead of time-stretching the first song 700 such that its measure 701 is transformed into a measure 721 that substantially matches measure 601 of the second song, we take the second song 600 and time-stretch it such that its measure 601 is transformed into a measure 621 that substantially matches measure 701 of the first song. In essence, the currently playing song may be the second song 600 in this embodiment, and the next song may be the first song 700. And since the measure 601 of the second song 600 is longer than the measure 701 of the first song 700, time-stretching the measure 601 involves shortening the length of the subsequences 602*a*, 602*b*, 602*c*, 602*d* into time-stretched subsequences 622*a*, 622*b*, 622*c*, 622*d*, respectively.

Figure 4F:
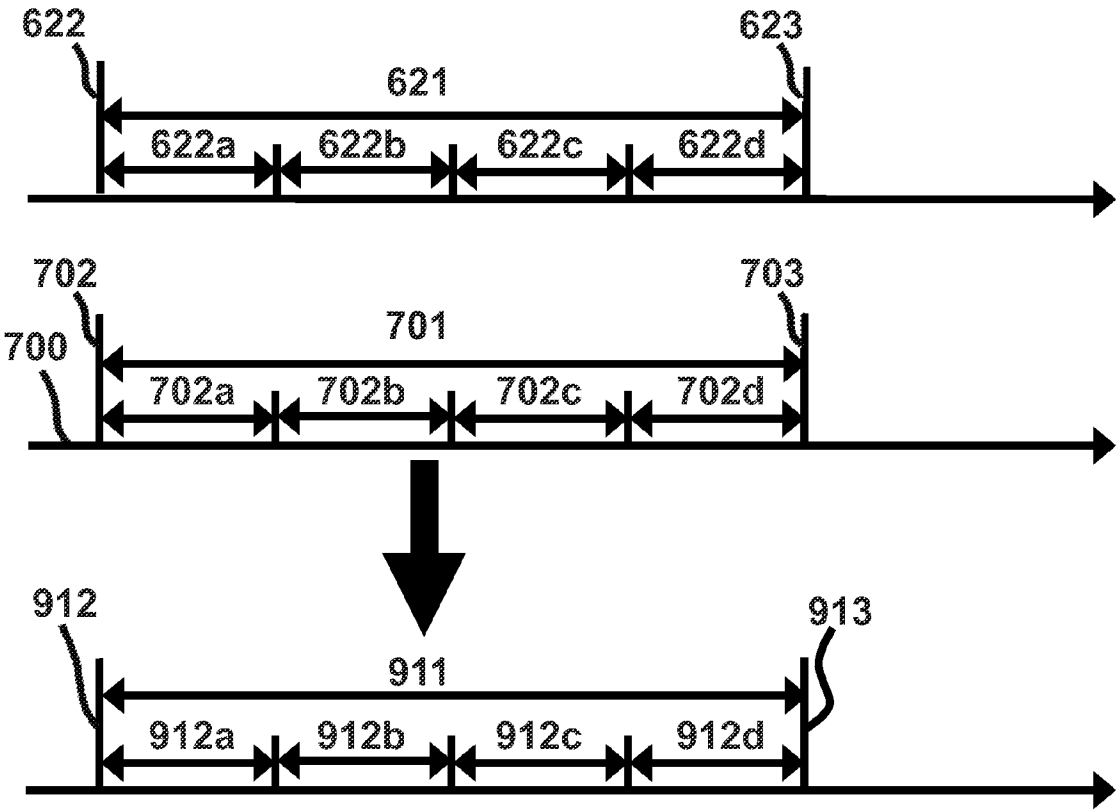

In FIG. 4F, we see how the time-stretched measure 621 of the second song 600 may be added to the first measure 701 to generate a transition measure 911. And in FIG. 4G, we see how the transition measure 911 may be time-stretched to generate a final transition measure 931. This last time-stretch operation, as before, generates a linear tempo ramp between the second song 600 (which is now the currently playing song) and the first song 700 (which is now the next song to which the program 20 is transitioning).

Figure 4G:
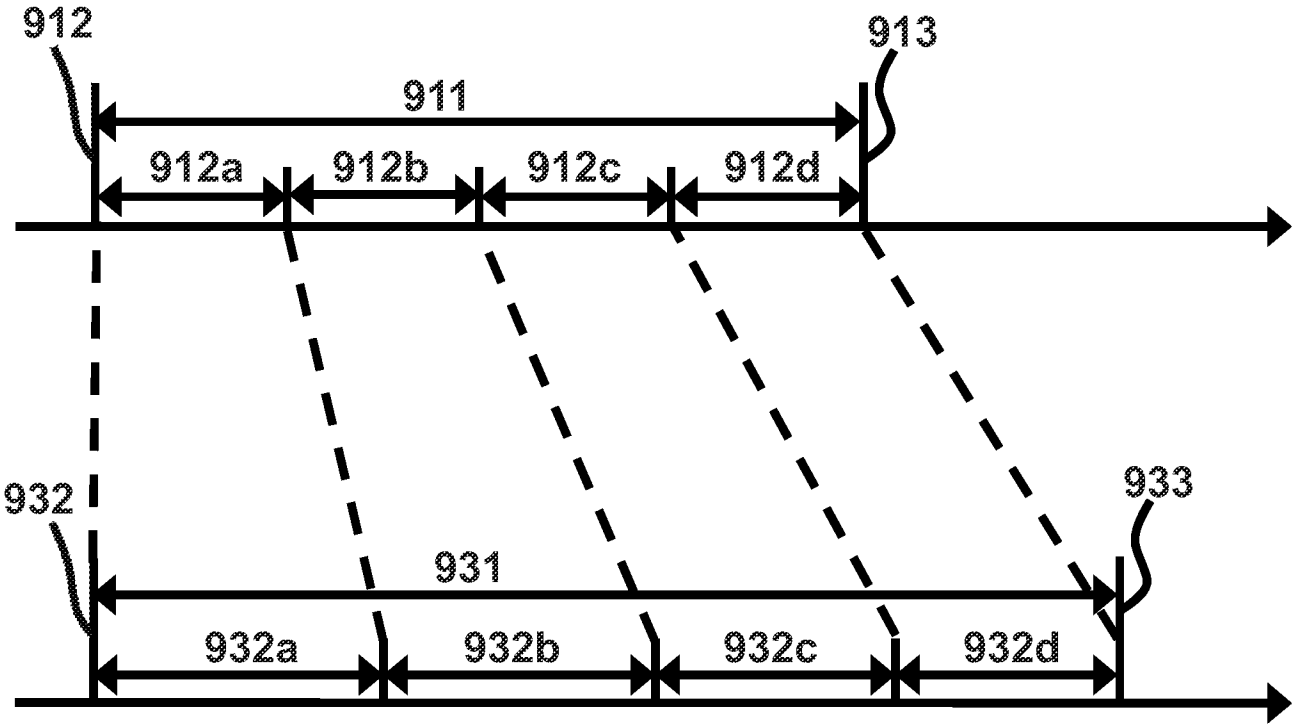

It should be understood that all of the previous statements and supplementary explanation made in relation to the embodiment depicted in FIGS. 4A-4D also applies to this embodiment depicted in FIGS. 4E-4G.

FIG. 5A-5G—Further Exemplary Embodiments for Generating a Transition

FIGS. 5A-5G show another exemplary embodiment in which a transition might be generated, this time at the level of measure groupings. A measure grouping 730 of a first song 700 is shown. This measure grouping 730 comprises six measures—measure 701 (which we encountered in connection with FIGS. 4A-4G above) and measures 730*b*, 730*c*, 730*d*, 730*e*, 730*f*. As noted in the diagram, the measures are not all the same length—for example, measure 730*d* has fewer frames than measure 701. This illustrates how the present embodiment may work when measure groupings have measures of different sizes. Other embodiments can involve measure groupings having measures of a uniform size.

In the present embodiment, the program 20 seeks to mix the measure grouping 730 with a measure grouping 1430 for a second song 1400. The measure grouping 1430 has eight measures in it —1430*a*, 1430*b*, 1430*c*, 1430*d*, 1430*e*, 1430*f*, 1430*g*, 1430*h*. So measure grouping 730 and measure grouping 1430 have different numbers of measures in them. In other embodiments, the measure groupings for the two songs being mixed may have the same number of measures in them.

Figure 5A:
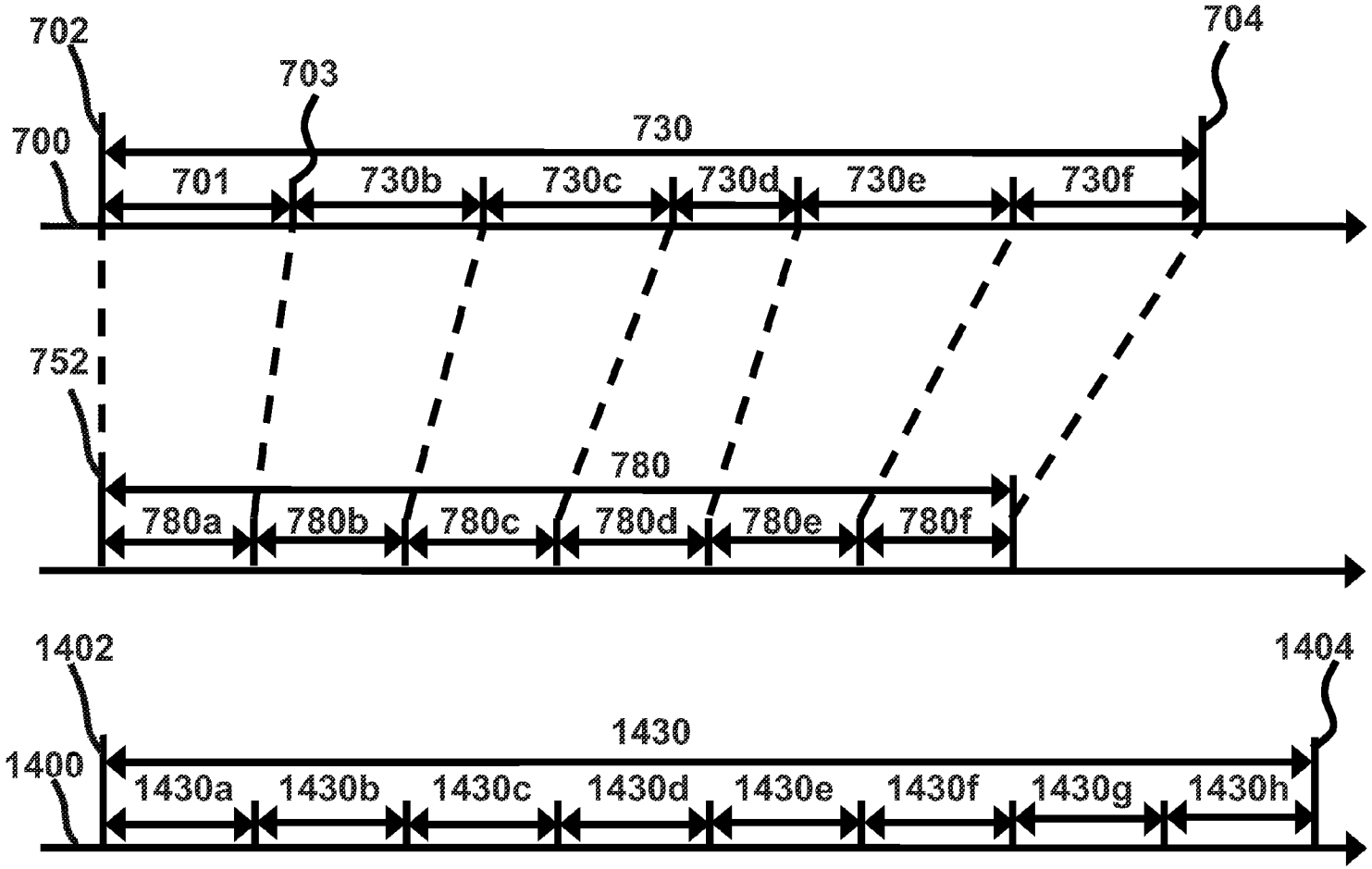
FIGS. 5A-5G are time diagrams illustrating exemplary embodiments for generating a transition between songs at the measure grouping level.

In FIG. 5A, we see that the measure grouping 730 can be time-stretched (or alternatively, arbitrary frames may be removed from the measure grouping 730) such that it becomes time-stretched measure grouping 780. Time-stretched measure grouping 780 matches up with the first six measures in the measure grouping 1430 (i.e., comprising measures 1430*a*, 1430*b*, 1430*c*, 1430*d*, 1430*e*, 1430*f*). So time-stretched measures 780*a*, 780*b*, 780*c*, 780*d*, 780*e*, 780*f*, have substantially the same number of frames as corresponding measures 1430*a*, 1430*b*, 1430*c*, 1430*d*, 1430*e*, 1430*f*, respectively.

It should be understood that in alternate embodiments, the time-stretched measures for the first song might be matched up against different measures in the measure grouping 1430. For example, the time-stretched measures for the first song might have been matched up against the last six measures of the measure grouping 1430 instead (i.e., 1430*c*, 1430*d*, 1430*e*, 1430*f*, 1430*g*, 1430*h*). More generally, it should be understood that any subset of measures in a measure grouping for a first song (e.g., a song that is currently playing) may be matched with any subset of measures in a measure grouping for a second song (e.g., a song that is to be playing next).

Figure 5B:
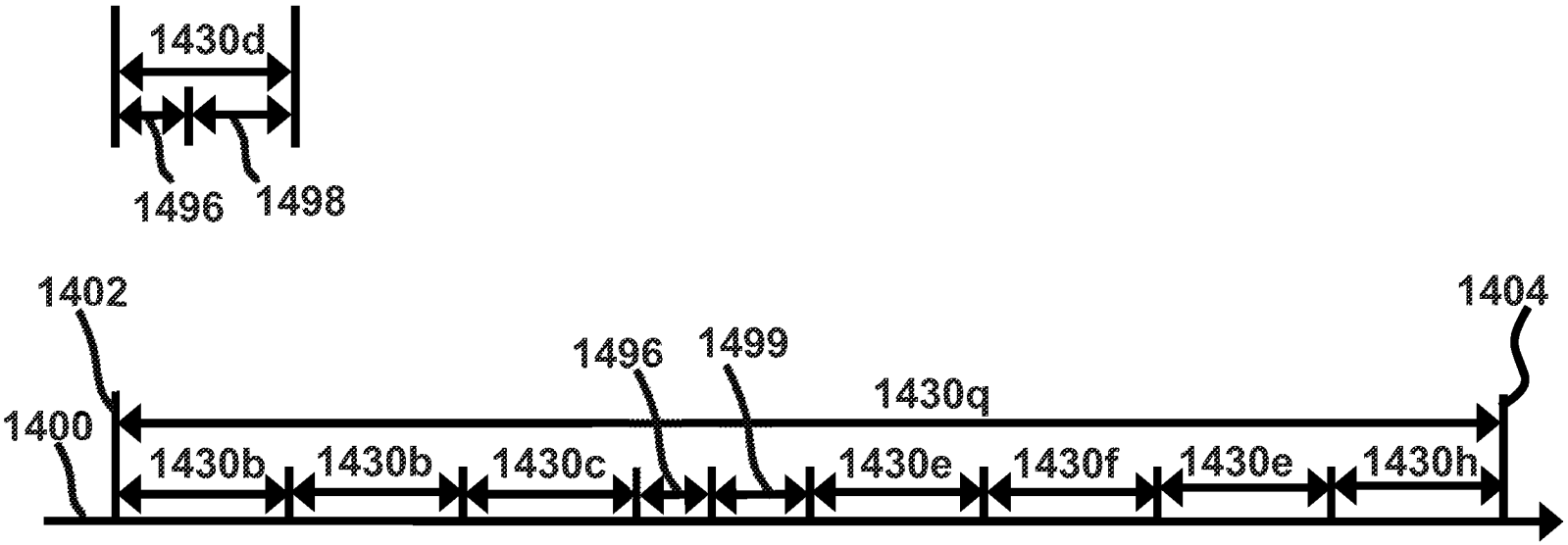

In FIG. 5B, we see measure grouping 1430*q*, an alternate embodiment of the measure grouping 1430 as shown in FIG.

5A. The boundaries of both measure grouping 1430 and measure grouping 1430*q* are defined by cuepoints 1402 and 1404, which might be part of the cuepoints 40 that are in the transition data 24. However, some of the measures within measure grouping 1430 have been changed, replaced, or looped by the program 20 to create measure grouping 1430*q*.

For example, comparing measure grouping 1430 and measure grouping 1430*q*, we see that measure 1430*a* has been replaced by measure 1430*b*. This will cause measure 1430*a* to play twice in a row in a "loop." Additionally, measure 1430*g* has been replaced by measure 1430*e* in measure grouping 1430*q*, which will cause this measure 1430*e* to play twice in a non-consecutive fashion.

We further see that measure 1430*d* from the measure grouping 1430 is actually comprised of two parts, segment 1496 and segment 1498. In measure grouping 1430*q*, segment 1498 has been replaced by segment 1499, a set of external frames that might have come from some external source, similar to subsequence 777 discussed earlier. Segments 1496 and 1499 have then been placed where measure 1430*d* used to be in measure grouping 1430. This example shows how a measure may be partitioned into smaller frame segments, which might be looped or replaced with external frames.

These examples should illustrate that different embodiments of the program 20 can perform any number of different operations on measure groupings and measures, similar to the operations they could perform on frame sequences and subsequences as discussed in connection with FIG. 4B. For example, the program 20 may change the number of frames (which may involve time-stretching) of any measure, reorder frames within any measure, or change the order of measures. The program 20 might also repeat portions of a measure to generate sub-measure loops, or repeat measures to generate measure loops. Or the program 20 might replace one or more of the frame values in a measure with an external frame value, which might come from the same song as contains the measure or from some other song data 30.

As in the context of sequences and subsequences, it should be understood that this list is not exhaustive, as the program 20 might do other things in other embodiments. For example, the program 20 might prepend (or append) an offset to any given measure.

Moreover, although the operations shown here are being performed on the measure grouping 1430 (in order to generate the measure grouping 1430*q*), it should be understood that these operations may be performed on any type of measure or measure grouping, whether time-stretched or not, or whether performed on a currently playing song or an enqueued song.

Additionally, as in the context of FIGS. 4A-4G, the user interface 28 may permit a user to select between various transition modes that determine how the program 20 operates on measure groupings and measures. For example, each transition mode might specify a different generic mapping between measures or measure groupings in a first song (e.g., a currently playing song, like the first song 700 here) and a second song (e.g., a next song to be played, like the second song 1400 here). The program may then apply the generic mapping to map one or more of the measures in the currently playing song to one or more measures in the song to be played next.

Figure 5C:
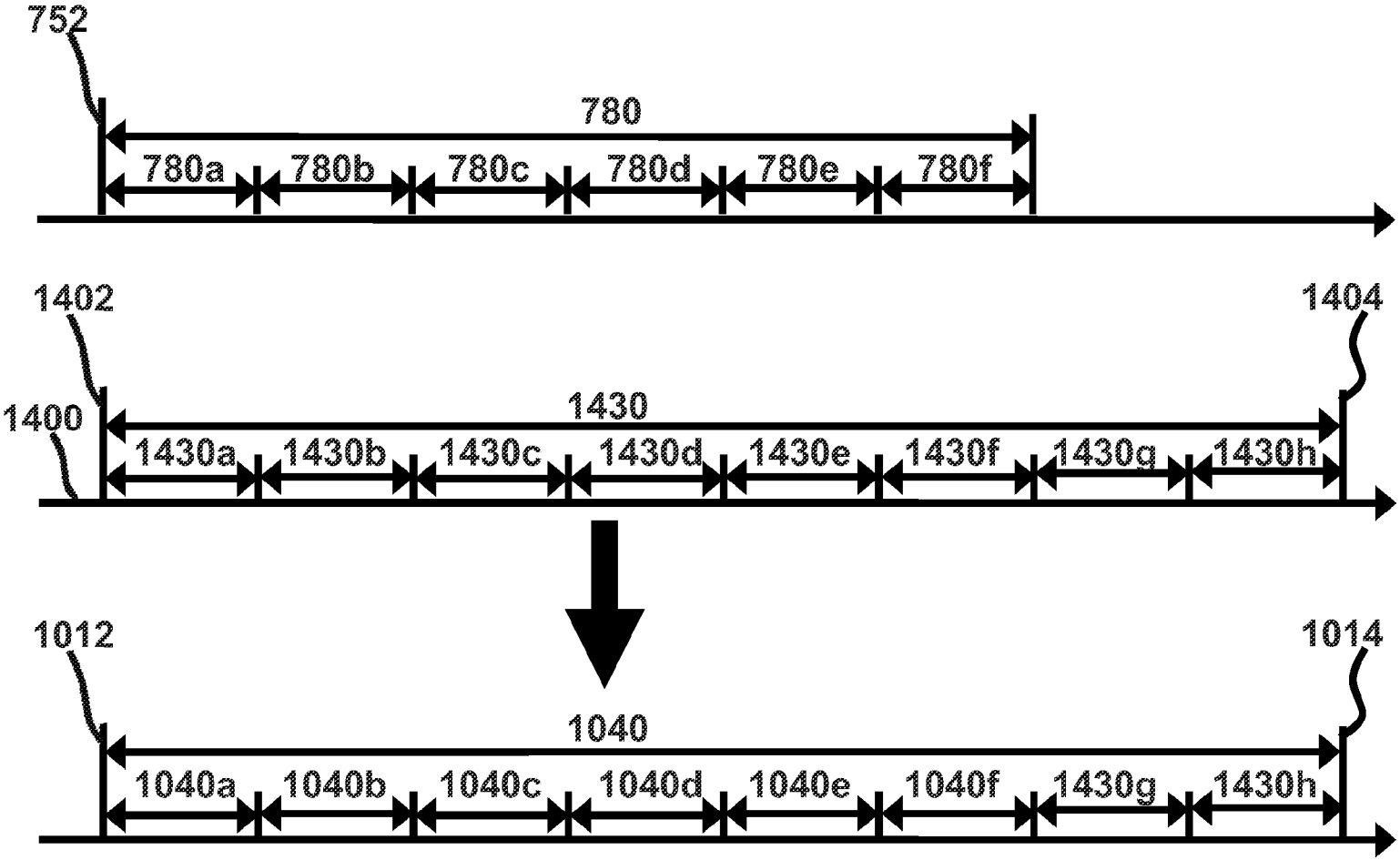

Turning now to FIG. 5C, we see how a transition may be generated from the time-stretched measure grouping 780 and the measure grouping 1430 from the second song 1400. It should be understood that any other pair of measure groupings may instead be used to get a different transition.

In FIG. 5C, we see that frame values from measure groupings 780 and 1430 may be combined to generate a transition measure grouping 1040, with transition measures 1040*a*, 1040*b*, 1040*c*, 1040*d*, 1040*e*, 1040*f*, 1430*g*, 1430*h*. This might be done by the transition generation unit 26 and/or one of its components, such as the combiner unit 37.

In FIG. 5C, the last two measures (1430*g*, 1430*h*) in the transition measure grouping 1040 are the same as in the measure grouping 1430; in this embodiment, that is because the measure grouping 1430 has two more measures than the measure grouping 780. It should be understood that in alternate embodiments, the measure groupings 780, 1430 may be combined in a different way. For example, alternatively, the last measure (7800 in measure grouping 780 might be appended twice to measure grouping 780, and the resulting extended measure grouping may be added with measure grouping 1430 to generate a different transition measure grouping.

As in the context of FIGS. 4A-4G, combining frame values of the two measure groupings 780, 1430 may involve merely adding the frame values of one song to another song. These measure groupings are substantially aligned in the present embodiment, as they have substantially the same number of frames in each of their respective measures (e.g., measures 780*a*, 780*b*, 780*c*, 780*d*, 780*e*, 780*f* have the substantially the same number of frames as measures 1430*a*, 1430*b*, 1430*c*, 1430*d*, 1430*e*, 1430*f*, respectively). So the program 20 may form the transition measure grouping 1040 by simply adding frame values for corresponding frames in the two measure groupings 780, 1430, as depicted in FIG. 5C.

As before, the measure groupings need not be perfectly aligned to be combined in this manner. Whether the measure groupings are substantially aligned might depend on a number of factors, such as the sensitivity of the audience to misaligned beats or frames (see previous discussion in connection with FIG. 4C). Additionally, as before, combining the two measure groupings 780, 1430 may involve using any number of filters, effects, overlays, or any other processing. The transition generation unit 26 may also shift the pitch of the transition measure grouping 1040 based on the musical keys of the songs at issue.

Figure 5D:
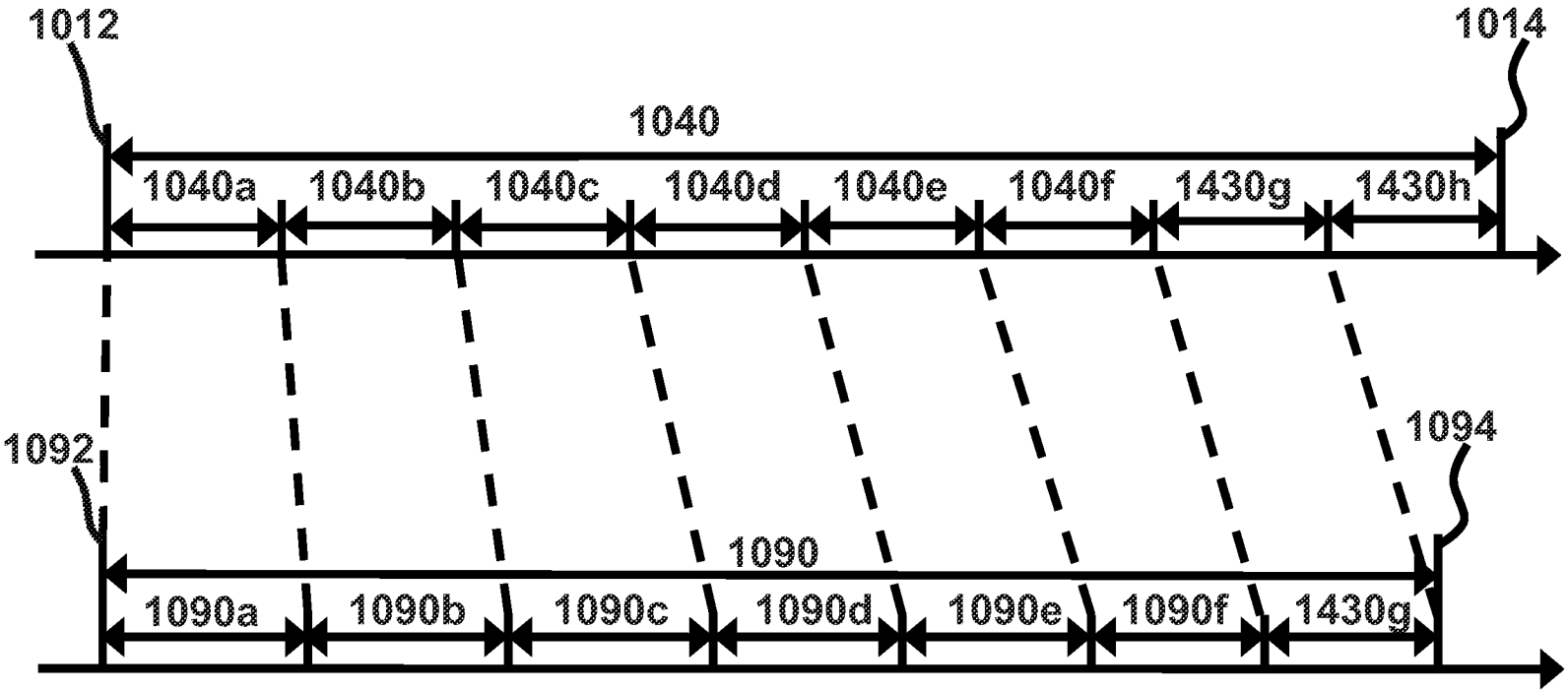

Now looking at FIG. 5D, we see how the transition generation unit 26 might alter the tempo of a transition (here, transition measure grouping 1040) to generate a smooth change in tempo from the first song 700 to the second song 1400. This results in a final transition measure grouping 1090. Similar to FIG. 4D, the unit 26 here uses a linear ramp to smooth out the tempo change across the transition measure grouping 1040 from the first song 700, which is somewhat slower than the second song 1400. Again, the program 20 may alternatively choose any arbitrary speed profile in generating the final transition measure grouping 1090. Alternatively, in some embodiments, the length of the final transition measure grouping 1090 might not depend on any characteristics of the first song 700 or the second song 1400 (see discussion related to FIG. 4D).

Also similar to the previous discussion in connection with FIGS. 4A-4G, the present embodiment does not require any time-stretching (or any other operation of adding/removing frames) to be done in any order. For example, in an alternative embodiment, both measure grouping 730 and measure grouping 1430 may be time-stretched first and then combined to generate the same final transition measure grouping 1090.

Figure 5E:
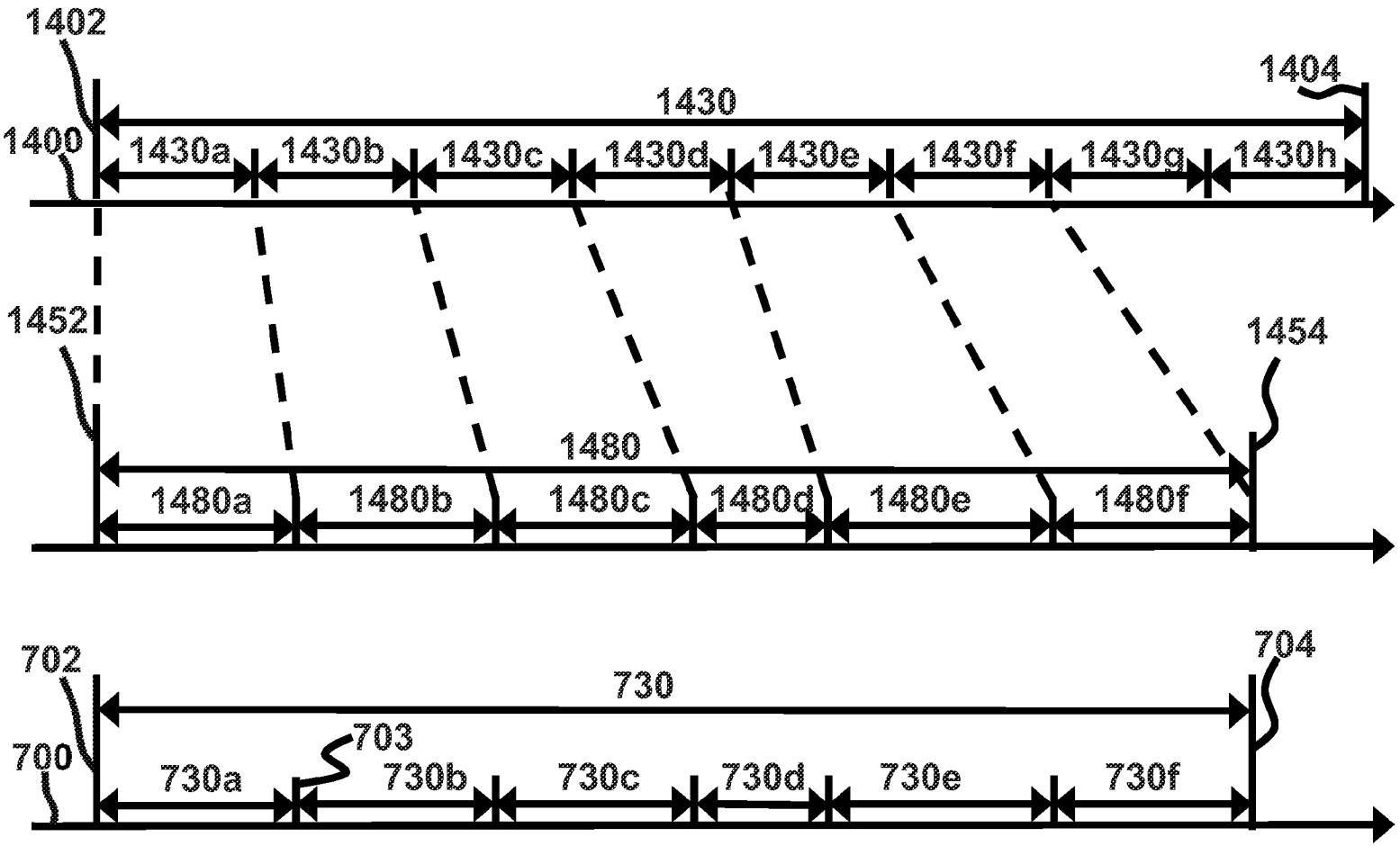
Figure 5F:
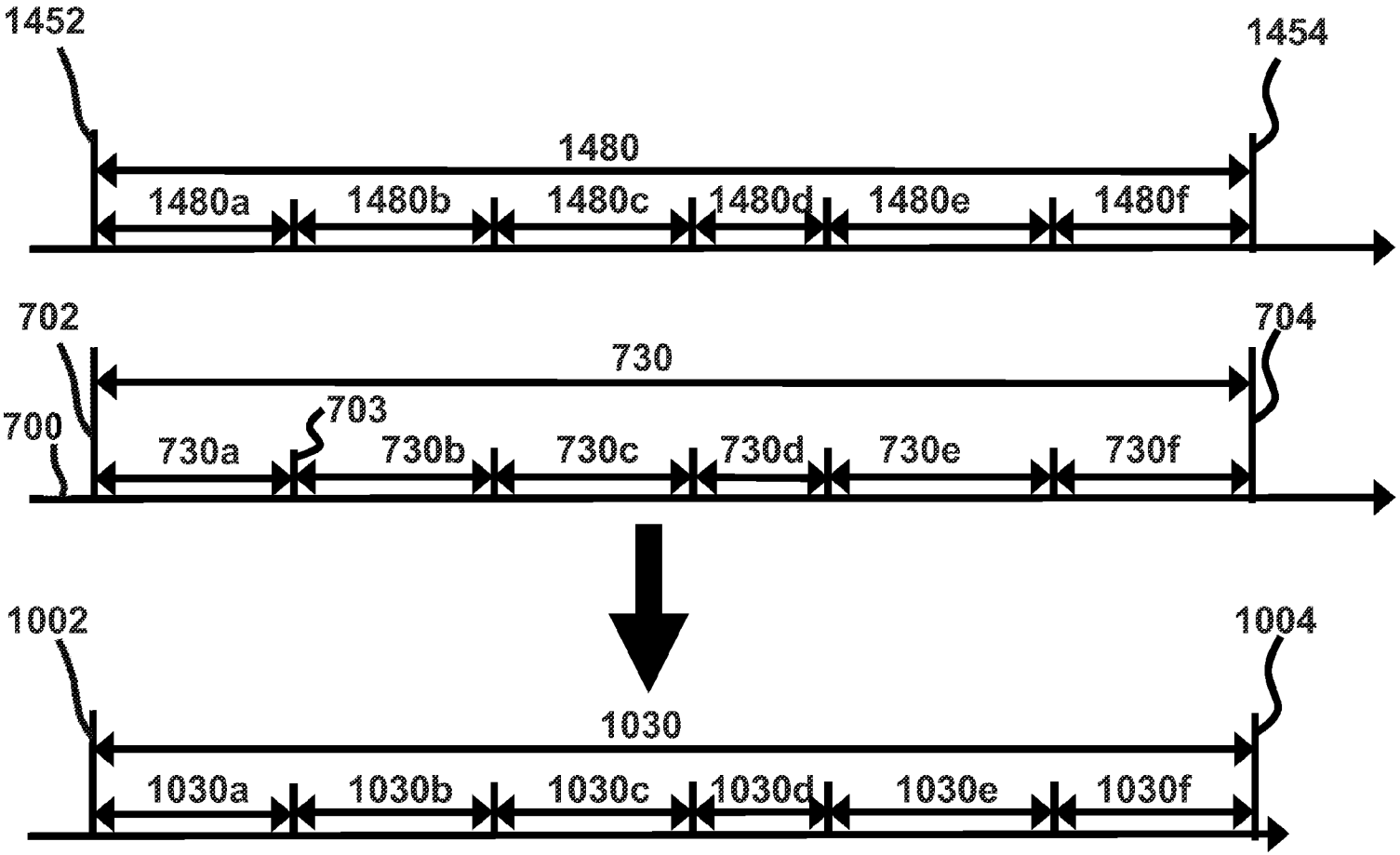

Turning to FIG. 5E, we see what happens when we switch songs—we instead time-stretch the measure grouping 1430 for the second song 1400 to match it to the measure grouping 730 for the first song 700. In FIG. 5F, we see how the time-stretched measure grouping 1480 of the second song 1400 may be added to the measure grouping 730 to generate a transition measure grouping 1030. And in FIG. 5G, we see how the transition measure grouping 1030 may be time-stretched to generate a final transition measure grouping 1080. This last time-stretch operation, as before, generates a linear tempo ramp between the second song 1400 (which is now the currently playing song) and the first song 700 (which is now the next song to which the program 20 is transitioning).

Figure 5G:
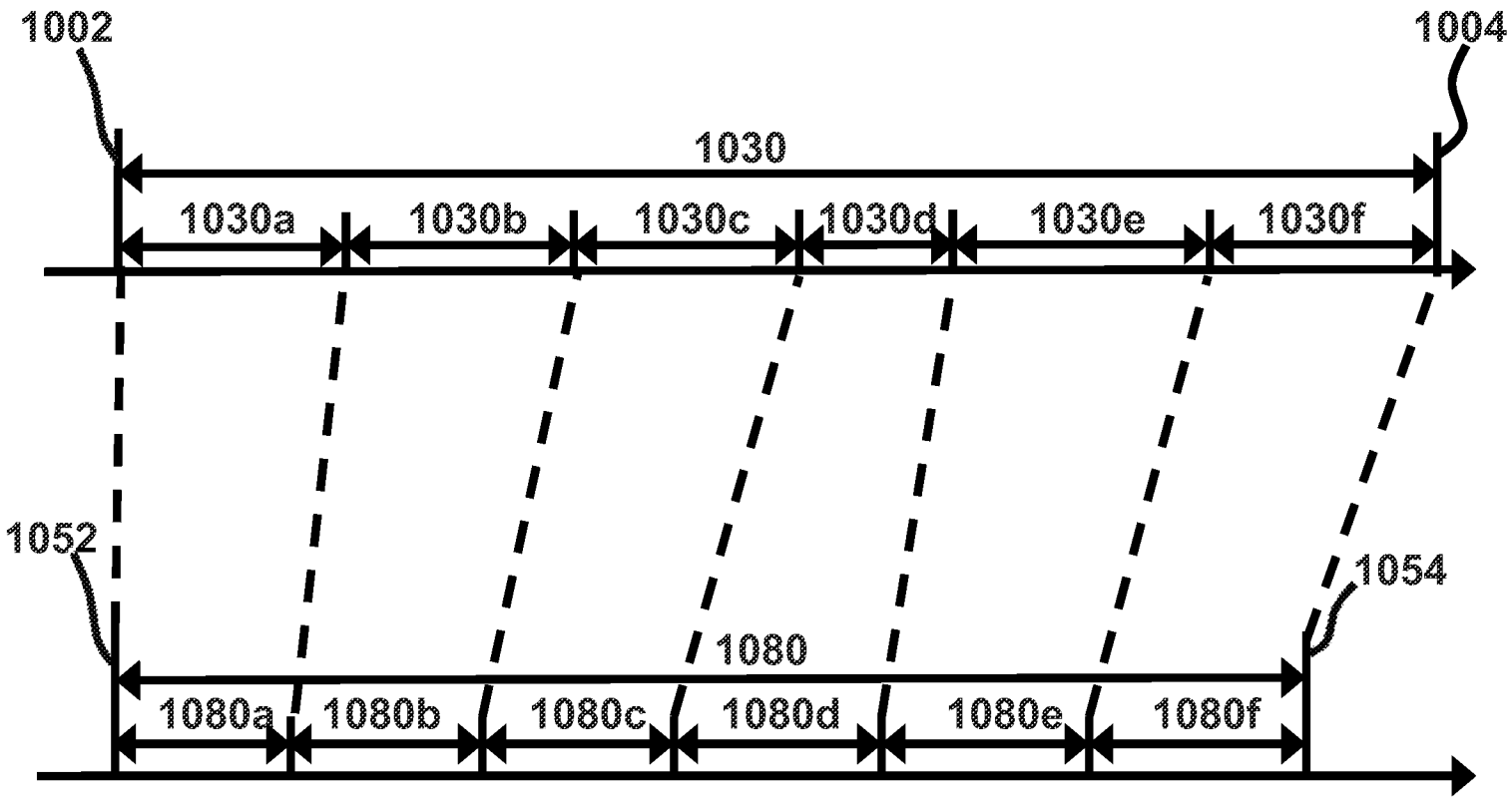

It should be understood that all of the previous statements and supplementary explanation made in relation to the embodiments encompassed by FIGS. 5A-5D also applies to the embodiments encompassed by FIGS. 5E-5G.

Figure 6A:
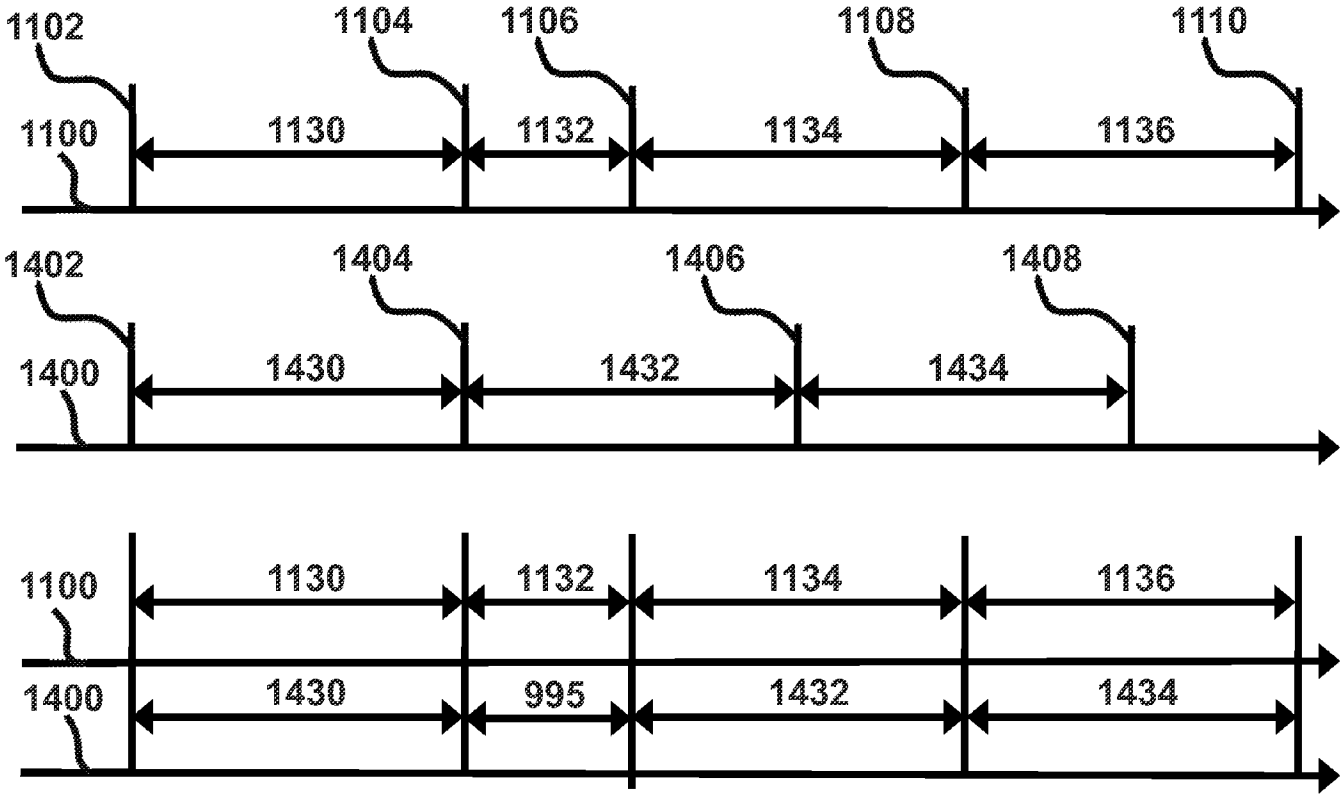
FIGS. 6A-6B are time diagrams illustrating exemplary embodiments for generating a transition between songs using multiple measure groupings.

Before turning to FIG. 6A, some other exemplary variants of the present embodiments should be noted. In one such embodiment, the system described here could be used to put together song fragments in a variety of ways. For example, the song data 30 might comprise portions of songs (e.g., measure groupings, measures, frames between beats). These portions might comprise, for example, portions of songs created by disc jockeys, who take songs and mix them with certain beats in order to create "remix" versions of those songs. The program 20 might take these song portions and allow individuals to combine them in a beat-matched fashion, through the generation of transitions (e.g., transition 50) based on these song portions. The resulting product might recreate some of these disc jockey mixes, or it might allow users to generate new mixes from these song portions.

Moreover, in alternate embodiments, the program 20 might generate transitions not just with song data 30, but also with data related to other media, such as videos or lights. For example, the program 20 might take video that is already synced to an existing audio track (like a music video). After generating a map of beats for the song, which might be done via an automated program, the program 20 might take the audio/video track and mix it with another audio track in a manner similar to that described above.

More generally, the present embodiment might map a media track (e.g., video, lights) and an audio track (e.g., song data) when both have cuepoints associated and beats associated with them. The media track and audio track may then be mixed based on these cuepoints and beats.

Alternatively, the program 20 might output a signal based on the beats of the songs and transitions it is playing. Such beats might allow the program 20 to synchronize with a separate beat-aware player (such as a computer running a different version of the program 20) or to a graphical display or lighting system or any other human interface system that might use a sequence of pulse data to trigger an action. For example, the program 20 might output the beats to a lighting system that might flash whenever a beat occurs. Or the program 20 might output the beats to graphical display or projection unit, such as a slide projector, a movie projector, a computer attached to a liquid crystal display screen, and the like. This graphical display or projection unit may show pictures (e.g., flash pictures, or switch between pictures in a slideshow) at the same rate as the beats outputted by the program 20.

Figure 6B:
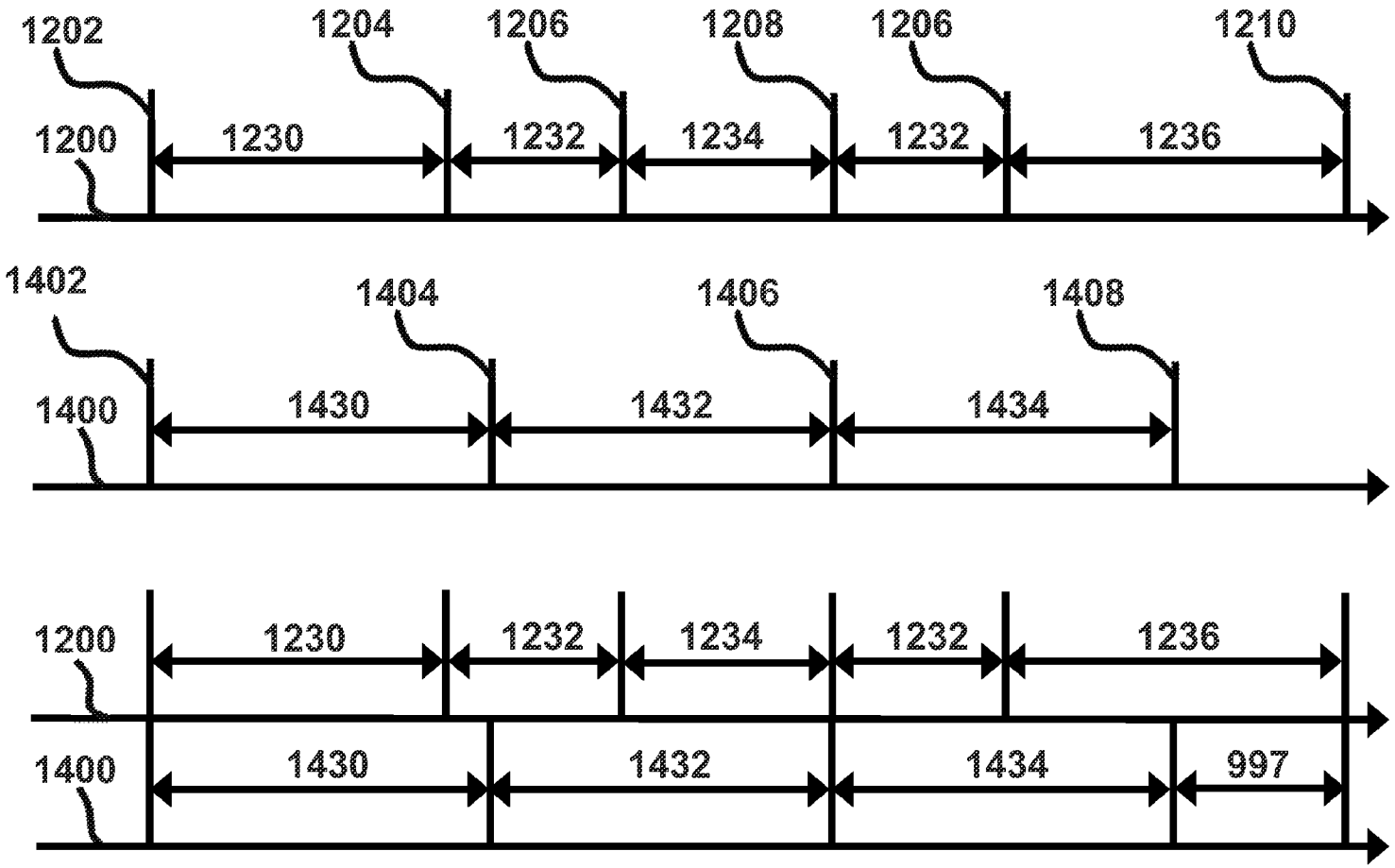

FIG. 6A-6B—Exemplary Embodiments Using Multiple Measure Groupings

Turning now to FIG. 6A, we see an exemplary embodiment showing how multiple measure groupings in different songs might be combined. FIG. 6A shows a first song 1100 with measure groupings 1130, 1132, 1134, 1136. The boundaries of the groupings 1130-1136 are defined by first song cuepoints 1102, 1104, 1106, 1108, 1110. We also see a second song 1400 (which might be the same as the second song 1400 discussed previously in connection with FIGS. 5A-5G) with measure groupings 1430, 1432, 1434, whose boundaries are defined by second song cuepoints 1402, 1404, 1406, 1408.

In FIG. 6A, we see that first song cuepoint 1102 is aligned (or at least substantially aligned—see previous discussion on this point in connection with FIGS. 4A-4G and FIGS. 5A-5G) with second song cuepoint 1402, and first song cuepoint 1104 is aligned with second song cuepoint 1404. The first song cuepoints 1102, 1104 define the measure grouping 1130, and the second song cuepoints 1402, 1404 define the measure grouping 1430. These two measure groupings 1130, 1430 are also aligned.

This alignment in measure groupings 1130, 1430 could have possibly occurred naturally (e.g., without any action by the program 20), but more likely resulted from time-stretching operations on one or both of the songs 1100, 1400. Either way, given this alignment, these two measure groupings 1130, 1430 may be combined, for example, in a manner similar to that specified in connection with FIGS. 5A-5G.

The remaining measure groupings in the songs are not aligned. However, the program 20 might perform one or more operations to make them aligned. For example, as shown at the bottom of FIG. 6A, the program 20 might insert an external measure grouping 995 to the second song 1400 after the measure grouping 1430. External measure grouping 995 may be any set of measures (or portion of measures) from either the second song 1400 or from any other form of song data 30. External measure grouping 995 is chosen such that is substantially the same length as measure grouping 1132. The external measure grouping 995 might also be chosen such that it sounds good when combined with measure grouping 1132 (see discussion in connection with FIGS. 4A-4G to see how this might be done).

By adding the external measure grouping 995 to the second song 1400, the measure groupings 1432, 1434 in the second song 1400 now align with the measure groupings 1134, 1136 in the first song 1100. As such, these measure groupings may now be combined, for example, in the fashion specified in FIGS. 5A-5G. Thus a mashup or combination of multiple measure groupings in the first song 1100 with the second song 1400 is now possible.

Turning to FIG. 6B, we see another exemplary embodiment where multiple measure groupings in different songs may be combined. First song 1200 has measure groupings 1230, 1232, 1234, 1236. Measure grouping 1232 repeats itself once in the song 1200, after measure grouping 1234. The measure groupings 1230-1236 are separated by first song cuepoints 1202, 1204, 1206, 1208, 1210. As in the previous embodiment, the second song to be mixed is song 1400, with the same second song cuepoints and measure groupings as specified in connection with FIG. 6A.

At the bottom of FIG. 6B, we see how the program 20 might combine the two songs 1200, 1400 across multiple measure groupings. Here, the program 20 might append an external measure grouping 997 after measure grouping 1434. This external measure grouping 997 might comprise any set of frames—for example, it might be part of measure grouping 1430, some other part of the second song 1400, or some other piece of song data 30 altogether.

Regardless, by adding the external measure grouping 997, it becomes possible to combine the first song 1200 and the second song 1400 across multiple measure groupings. In particular, three measure groupings 1230, 1232, 1234 in the first song 1200 may be combined with two measure groupings 1430, 1432, and two other measure groupings 1232, 1236 (at the end of the first song 1200 as shown in FIG. 6B) may be combined with measure groupings 1434 and 997 in the second song 1400.

While the present embodiments show how multiple measure groupings may be combined in two songs, it should be understood that by mapping cuepoints and measure groupings, it becomes possible to combine any number of songs in any number of ways. For example, after the first song 1200 and the second song 1400 have been combined in the manner specified in FIG. 6B, another song (say first song 1100 in FIG. 6A) may also be combined with the songs 1200, 1400. This other song may be any kind of song data 30, such as a standard musical composition, a "beat" track, a musical fragment, a drum-and-bass rhythm, or any other audio fragment, wherein time-shifted, pitch-shifted, or not.

This process may be iterated any number of times as desired by the user, who may select his preferences via the user interface 28. Additionally, as discussed previously in connection with FIG. 3A-3D, user feedback and/or preferences may be used to optimize combinations of multiple measure groupings in songs that might sound good when played together. Moreover, any of the actions that the program 10 was able to take at the measure or measure grouping level (e.g., replacing frames, looping segments, moving subsequences, repeating measures, etc.) may be performed on any portion of the measure groupings 1230, 1430 that are combined.

FIGS. 7A-7B—Exemplary User Interface

Now turning to FIGS. 7A-7B, we see an exemplary user interface 28. The user interface 28 is split among these two diagrams. The top half, which includes many of the user controls and display, is shown on FIG. 7A. The bottom half, which shows a playlist 1348 of upcoming songs, is shown in FIG. 7B. It should be understood that the interface 28 shown here is merely exemplary, and as stated earlier many other types of interfaces in any number of different layouts may be used. For example, while "buttons" are used for many components of the exemplary interface 28, any number of other input mechanisms might be used. For instance, the playlist 1348 may be an interface by itself and accept input if, for example, it is a touchscreen-type of interface. Moreover, certain components that are pictured separately may instead be incorporated within one another or deleted, and other components not pictured here may instead be included.

The user interface 28 shown here has a current song listing 1318 that identifies the title and artist of the currently playing song. There is also a graphical section 1334 showing a waveform 1332 and cover art 1336 for the song, and a progress meter 1330 showing how much of the song has been played.

The progress meter 1330 may have a scrubber 1331 that a user may adjust to move around to different portions of the song. In an exemplary embodiment, if the user drops the scrubber 1331 at a point in the song, the song may immediately start playback at that point. Alternatively, dropping the scrubber 1331 may cause the program 20 to initiate a beat-matched transition from the current portion of the song that is playing to a portion at or near where the scrubber 1331 was dropped. In other words, instead of having an abrupt discontinuity in playback when the scrubber 1331 is moved, the player 22 may maintain a beat-matched sound by mixing the currently playing song with itself at or near the point where the scrubber 1331 is set to resume playback.

If the currently playing song has a constant or nearly constant beats-per-minute count, then beat-matching where the scrubber 1331 drops may take minimal computational effort, since no time-stretching or adding/removing frames would be used to generate the transition. In yet another embodiment, dropping the scrubber 1331 at another point in the song may cause it to jump to the nearest beat, cuepoint or measure startpoint and begin playback there once the playhead reaches the next beat, cuepoint, or measure startpoint in the currently playing section of the song.

Returning to the user interface 28, the exemplary embodiment here also has various control buttons, including a play button 1302 that triggers playback of a currently loaded song. Pressing the play button 1302 while a song is currently playing may cause the song to pause playing, to fade out, or to stop immediately, depending on the specific implementation used. Alternatively, other embodiments may include a separate pause and/or stop button.

The interface 28 also has a volume control button 1310, which might be used to raise or lower the volume. Alternatively, the interface 28 may have a slider (not shown) to accomplish this functionality.

Additionally, the interface 28 has an advance button 1304, which might trigger an advance signal, such as the advance signal 318 shown in FIGS. 3A-3D. An advance signal might trigger the program 20 to initiate a transition to a next song 1390, which might be specified in the playlist 1348. Alternatively, an advance signal may be triggered by clicking on or otherwise selecting the next song 1390 in the playlist 1348. A transition initiated by an advance signal may be a beat-matched, measure-aware transition, generated in a manner similar to the embodiments discussed in connection with FIGS. 4A-4G, 5A-5G, and/or 6A-6B.

If the advance button 1304 is pressed twice in a row, it might indicate that a user wishes to skip directly to the next song 1390 without a transition. In such a case, the transition might be skipped and the next song 1390 will be directly played. Alternatively, the next song 1390 may be faded into the current song, or the interface 28 may have a separate button to initiate this kind of skip functionality. This kind of fast advance may also be triggered by pressing the advance button 1304 during playback of a transition.

The interface 28 also has a loop button 1308, which might be a button that stays depressed until it is pressed again (the button 1308 might change graphically to indicate that it is depressed). Depending on user preferences and on the mode in which the player 22 is set, pressing the loop button 1308 might cause the player 22 to loop a currently playing song, measure grouping, measure, or sequence or subsequence of frames. Alternatively, a loop might not be initiated until the playhead reaches the next loopable section of the currently playing song.

If the loop button 1308 is undepressed (e.g., it is selected again after it has been depressed), the program 20 may then transition out of the repetitive beat and back into the current song. The playback experience might thus resemble entering a repetitive loop after the button 1308 is depressed and then resuming playback after it is undepressed. Such a mode may enable a user to play a current song for longer than its runtime, giving her more time to decide on what she wants to hear next.

Other buttons on the user interface 28 might include a positive ratings buttons 1312 and a negative ratings button 1314. Based on which button 1312, 1314 (if any) is pressed, the program 20 may be able to discern whether a user liked a particular song or transition to a song. This information may be sent to the server 32 over the network 29 using messages 27. As described earlier, this information may be used to tailor the player 22 to a particular user's preferences. It might also be used to aggregate information on user preferences and determine player 22 and/or program 20 settings for other users.

The exemplary interface 28 may also have various customizable buttons 1320-1326. These might be programmed by the user or take certain preset values that may be altered. The buttons 1320-1326 shown here are merely exemplary, and it should be understood that their nature might vary widely.

For example, in the present embodiment, button 1320 is listed as a "Flashback" button. Pressing this button might cause the player 22 to auto-populate the playlist with songs from a particular past era that the user enjoys. For example, if the user enjoys 1980s music, he could program the Flashback button 1320 such that pressing it loads 1980s music into his playlist.

What songs are loaded, and in what order, might be determined by the program 20, which might account for song characteristics in order to choose a playlist that sounds best when songs transition from one to another.

This same concept may be applied to particular artists ("Lady Gaga" button 1322 will put Lady Gaga songs in the playlist), genres ("House" button 1324 will put various house music in the playlist), albums, or any arbitrary favorite selection. A customizable button might also load in pre-specified playlists that are generated by the user, someone else (e.g., an expert music listener) or the program 20 itself. For example, the "Party Mix" button 1326 might load various party music that the user has selected into the playlist.

Another part of the interface 28 may be a variable display 1340, which changes depending on which of a set of tabs 1338, 1342, 1344 has been selected. In the exemplary embodiment shown in FIG. 7A, the display 1340 shows a list of songs (with artist/song name displayed) that have previously played on the system. An alternative embodiment might, for example, show additional information about the songs, such as time of the song, genre, and the type of transition used to enter or exit the song.

User interface 28 also includes a preview tab 1342. In some embodiments, such a tab might play preview clips of songs that are in the playlist, or other songs to which a user may want to listen (if, for example, one of the customizable buttons 1320-1326 is depressed). Preview clips might be particularly useful to sample music that the user does not yet own and is considering purchasing. Transitions to these preview clips may be a beat-matched, measure-aware transition in an exemplary embodiment.

The preview clips might also be based on songs in the playlist; selecting the preview tab 1342 may thus cause the player to only play small portion of the next song 1390 and subsequence songs in the playlist, to help the user determine whether they are worth playing for longer. If a user decides to stay on a particular song, she may click the preview tab 1342 or some other pre-specified button again to stay on the song that is playing In an alternative embodiment, selecting the preview tab 1342 may cause the player 22 to preview part of the next song 1390 while the current song is still playing. Many users may find this useful, as it would enable them to see what the next song 1390 sounds like without having to stop playback of the currently playing song. Indeed, this might be particularly useful for systems that have only one audio output (and so previewing the next song 1390 without playing it would be difficult). So by playing the next song 1390 on top of the current song, the user may preview what the song sounds like. This might also be useful for testing an audience's reaction to the preview portion of the next song 1390, which might be useful in determining whether the entire next song 1390 should be played.

The exemplary embodiment also includes a radio tab 1344. Selecting this tab 1344 may allow the user to select a radio station, which may, for example, be an Internet radio station. A variety of such stations might be available; their names or a description of them might be shown in the display 1340 when the tab is selected, allowing the user to select one. When a radio station is selected, the program 20 may initiate a beat-matched transition from the currently playing song (which may be from the user's personal collection and pulled from his playlist) to whatever song happens to be playing on the radio station that was selected. If, for example, a song in the playlist is selected again, the program 20 may initiate another beat-matched transition back to that song from whatever song was playing in Internet radio.

In this sense, the present embodiment might allow a user to seamlessly switch between an Internet radio station and a song in a playlist. Such a playlist song may be any kind of song data 30.

Additionally, during Internet radio playback, advertisers may be able to intersperse commercial audio advertisements that are beat-matched and are mixed with other song data 30 being broadcast on the radio. Such a mode of advertising might be less disruptive to the radio experience, while still allowing advertisers to get their message across to listeners.

Other tabs not shown in the present embodiment are also possible. For example, the interface 28 might have a playlists tab. Selecting this tab may cause a list of playlists to appear that the user might select. As mentioned previously, these playlists may be automatically generated by the program 20 and/or server 32, or they may be generated by the user or another individual. The interface 28 might also have an "About" tab, which provides information on the player 22 and/or program 20, and a "Transitions" tab, which describes the various transition mappings available between songs Turning to FIG. 7B, we see the exemplary playlist 1348. Songs in this playlist 1348 may be added, removed, reordered, or changed. Changing a song may present another interface (not shown), where a song may be selected from a list that may include a search interface that filters or adds selections to the list.

In this playlist 1348 (which may look very different in other embodiments), we see that for each entry, there is a listing of the song name 1360, artist name 1370, and running time 1380 of the song.

We also see there are transition types 1350 listed for each song. In the present embodiments, these types 1350 describe the kind of transition that would be used when introducing the song. For example, for the next song 1390, we see that the song will be introduced using a "Type B" style transition. The second queued song 1392, on the other hand, is being introduced by a "Type A" style transition These different transition types might be, for example, some specific mapping at a frame, subsequence, frame sequence, measure, measure grouping, and/or multiple measure groupings level. Many examples of such possible mappings were discussed previously in connection with FIGS. 4A-4G, 5A-5G and 6A-6B.

It should be understood that any part of the user interface 28 may be laid out in other embodiments in a way different from the way shown in FIGS. 7A-7B. For example, alternate embodiments may have additional or less functionality that the user interface 28 shown here. To illustrate, in alternate embodiments, the user interface 28 may have a slide control that affects or adjusts the quality of the current song (e.g., equalizer or a volume slider). For example, the slide control may affect the degree of turntable scratch effects present on the transition, the type of transition, or any other parameter related to a transition.

Alternatively, the interface 28 may present an intermediate song interface, which allows the user to select a sequence of songs that will allow a more gradual and subtle between the currently playing song and some target song that the user wants to play. The program 20 may determine such an exemplary playback sequence in various ways (e.g., analysis from previous user sessions, use of volume envelopes, pitch analysis of songs, etc.).

Figure 8:
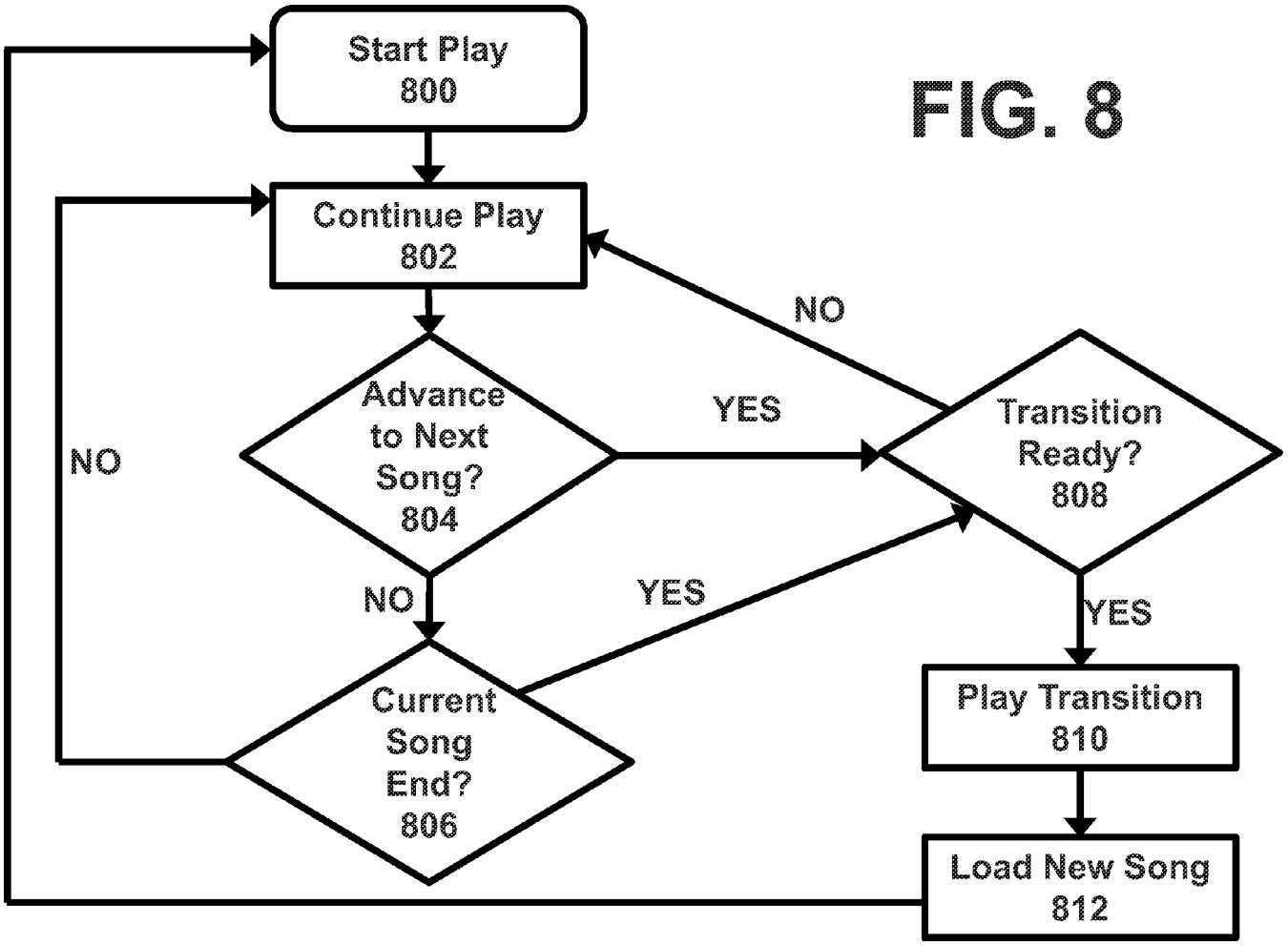
FIG. 8 is a flow chart showing an exemplary method for switching to and playing a transition.

FIG. 8—Exemplary Method for Playing a Transition

Turning now to FIG. 8, we see a flow chart that shows an exemplary method for performing an embodiment. While we discuss the method here with respect to certain embodiments previously discussed, nothing here limits the scope of the method, as it can be practiced in a variety of ways with any of the possible embodiments.

The method begins when a user (or some other person or mechanical process) initiates playback of a song or other audio file (step 800). In this step 800, the player 22 may begin playing song data 30 received from a buffer (such as playback buffer 23) that is filled by the program 20 or some component outside the program (e.g., external player 32 in FIG. 1B).

In step 802, the player 22 continues to play the current song (e.g., the first song 304, as shown in FIG. 3A-3D). As discussed previously, the artist name, song name, or other information about the current song might be visible in the user interface 28 via, for example, the current song listing 1318 (as shown in FIG. 7A)

In step 804, the player 22 determines whether to advance to the next song (e.g., the second song 312) while continuing to play the current song. The decision whether to advance may depend, for example, on whether the program 20 has received a signal to advance (such as the advance signal 318 as shown in FIGS. 3A-3D) from a user, who might have triggered such a signal by pressing a button such as advance button 1304 on the user interface 28. The user may have selected the next song via the user interface 28, and information about the next song may, for example, be visible in the next song listing of the user interface 28 in the next song listing 1390 (as shown in FIG. 7B). Alternatively, depending on a playback mode selected by the user, the program 20 may generate an advance signal on its own (see previous discussion in relation to FIGS. 4A-4G).

If the program 20 decides not to advance, it may proceed to step 806, where the program 20 checks whether the current song is nearing its end. Similar to the decision in step 804, the decision in step 806 might depend on receiving the advance signal 318. The advance signal 318 might be generated by the program 20 itself, which tracks what portion of the first song 304 is playing. For example, the program 20 might track a playhead frame number, which might be a frame number associated with a frame of the song that is currently playing. If the playhead frame number gets close to a frame number associated with the end of the song, the program 20 might decide to advance to the next song. This might cause the program 20 or a component within the program 20 to trigger the advance signal 318, which in turn triggers the advance. It should be understood as before that "advance signal" should be construed broadly —a signal in this context might be an actual electrical signal (e.g., a flag that is raised, or variable value that is changed in response to getting near the end of the song) or it might be any other way in which the program 20 becomes aware that the end of the song is approaching.

If the current song is not nearing its end, the program 20 will go back to step 802 and continue playing the current song. The program 20 will then proceed once again to step 804, and this cycle will continue until, for example, the advance signal 318 is received.

If in either step 804 or 806, the answer to the question at issue is in the affirmative (e.g., an advance signal 318 is received), then the program 20 will seek to advance to the next song. In such an instance, the program 20 will proceed to step 808, which checks whether an appropriate transition (such as transitions 50, 50*a* shown in FIG. 3A-3D) is available for playback.

Whether a transition is available may depend on whether it has been rendered and is ready for playback. This might depend on the playhead location within the current song, the location of the next song at which the program 20 seeks to enter, what transition mode the user might have chosen via the user interface 28, and any number of other factors, such as the processing capacity of the computer system running the program 20, the availability of cuepoints 40 for mixing purposes, and latency over the network 29. For example, in a "smooth transition mode" (which might be, for example, the "Type A" transition discussed earlier in connection with FIG. 7B), an appropriate transition might be one that smoothly bridges between the current song and the next song.

It should also be noted that a transition does not necessarily have to be "pre-rendered" in order for it to be considered ready. In some embodiments, a transition may be rendered in real-time, right before or at playback time.

Regardless of when or how it is rendered, in the present embodiment, if the program 20 determines that an appropriate transition is not available, then the program 20 will cycle back to step 802 and keep playing the current song. If the program 20 determines that an appropriate transition is ready, the program 20 will then proceed at the appropriate time to step 810, which involves playing the transition. It should be noted that the program 20 may move to this step 810 at any time—depending on the embodiment at issue, the program need not wait until the playhead reaches one of the cuepoints 40 in the currently playing song.

After the program 20 plays the transition in step 810, it will proceed to step 812, which will involve loading a new song into the player 22. This step may involve looking at what song has been specified by the user as the next song 1390 in the user interface 28. Alternatively, the program 20 may adopt certain default rules to govern the choice of the next song. For example, if the user has not specified a next song, or for some reason the next song that the user has specified is not available for playback, the program 20 may choose another song, such as the song that just played (referred to as the current song above) and play that or some portion of that again. Or the program 20 may loop portions of songs to fill time until an appropriate next song has been identified and is ready for playback.

After the next song has been loaded in step 812, the method will go back to step 800, and the player 18 will begin playback of the next song. The method will then proceed again, as the next song will become the currently playing song and the program 20 will identify a new next song to be played (e.g., this might be the second queued song 1392, as shown in FIG. 7B).

Although FIG. 8 shows a specific order of executing steps 800-812, it should be understood that the order of execution may be changed in alternate embodiments, that steps may be combined, and that other steps may be omitted. For example, steps 804 and 806 may be combined into one step—has the advance signal 318 been received (whether it comes from a user pressing the advance button 1304 or if the program 20 generates the signal on its own based on playhead location).

In addition, any number of commands, state variables, messages or the like may be added to the logical flow of this method.

Figure 9:
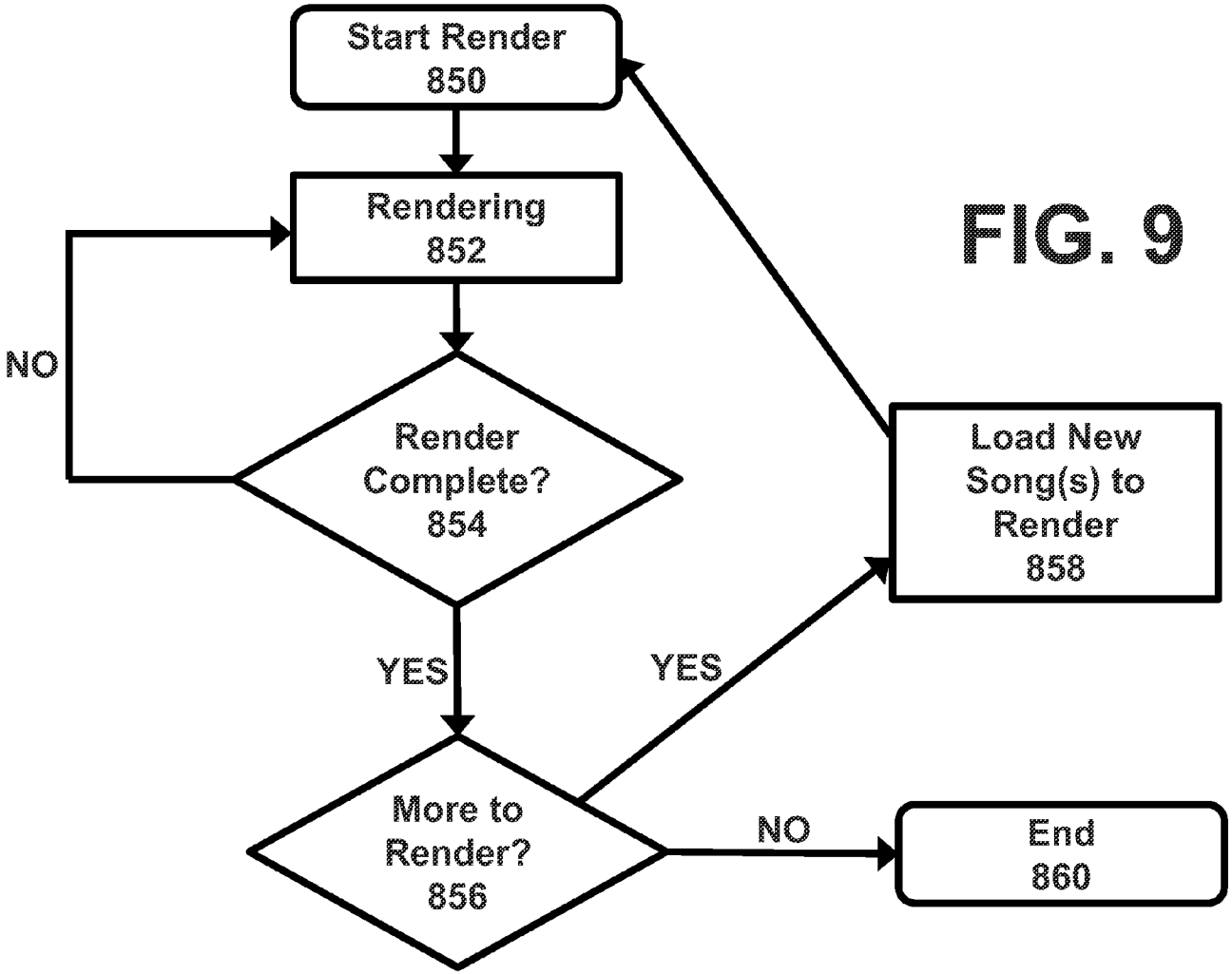
FIG. 9 is a flow chart showing an exemplary method for determining transition rendering.

FIG. 9—Exemplary Method for Determining Transition Rendering

We now turn to FIG. 9, which shows an exemplary method by which transitions may be rendered by the program 20 or one of its components (e.g., the transition generation unit 26). In step 850, the program 20 begins rendering a transition and in step 852, it continues the process of rendering.

Rendering involves steps previously discussed in this specification, such as time-stretching or changing the number of frames in one or more songs, filtering frames, applying a linear ramp, and so on (see discussion in connection with FIGS. 4A-4G, 5A-5G, 6A-6B). This step will vary depending on the particular transition mode chosen, the type of song data 30 being processed, and a variety of other factors, such as availability of computing power, connectivity to the network 32, etc.

In step 854, the program 20 determines whether the rendering of the transition is complete. If it is not, the program 20 continues rendering by proceeding back to step 852. If rendering is complete, the program 20 proceeds to step 856, where it determines if there are more transitions to render. Whether there are more transitions to render will depend on factors similar to the ones listed above and previous portions of this specification.

If the program 20 determines there are no more transitions to render, then the process moves to step 860 and terminates. Otherwise, if there are more transitions to render, the program 20 proceeds to step 858, where it loads in the one or more new songs that will be rendered by the program 20. The program 20 then returns back to step 850, where it begins rendering the new transition.

As with the previous flow chart in FIG. 8, it should be understood that this is merely a description of one potential rendering process. Many other rendering processes may be possible in other embodiments. For example, steps might be combined (e.g., steps 852, 854 here) and new steps might be added (e.g., determining a ranking among the generated transitions as most to least preferable).

It should be understood that a wide variety of additions and modifications may be made to the exemplary embodiments described within the present application. For example, in alternate embodiments, the user interface 28 may give users the ability to purchase songs they hear on the Internet radio or via preview clips. Additionally, the order of steps 804, 806, and 808 in FIG. 8 can be shuffled in any way—for example, the program 20 can see whether a transition is ready at any point prior to determining whether it should advance to the next song. Moreover, it should be noted that the section headings in the description were provided as a mere convenience for the reader, and they should not be understood as limiting the embodiments or scope of the invention in any way.

It is therefore intended that the foregoing description illustrates rather than limits this invention and that it is the following claims, including all of the equivalents, that define this invention:

What is claimed is:

1. A system for mixing songs comprising:

a memory unit storing a first startpoint for a first song, wherein the first startpoint corresponds to a first measure grouping in the first song;

a transition generation unit that generates a transition between the first song and a second song using the first measure grouping, wherein the transition generation unit tracks playback of the first song using a playhead frame number and uses the playhead frame number to select the first startpoint from first song cuepoints; and a player that plays at least a portion of the first song, followed by the transition, followed by at least a portion of the second song.

2. The system of claim 1, wherein the memory unit stores a second startpoint for the second song, wherein the second startpoint corresponds to a second measure grouping in the second song.

3. The system of claim 2, wherein the transition generation unit combines the first measure grouping and the second measure grouping to generate the transition.

4. The system of claim 2 further comprising a user interface that provides at least one transition mode for selection by a user, wherein the at least one transition mode specifies a priority ranking.

5. The system of claim 4, where the transition generation unit uses the priority ranking to select the second startpoint from second song cuepoints.

6. The system of claim 5, wherein the transition generation unit calculates a first volume envelope for the first measure grouping and second volume envelopes for measure groupings marked by the second song cuepoints.

7. The system of claim 6, wherein the transition generation unit selects the second startpoint from the second song cuepoints based on a comparison of combinations of the first volume envelope with each of the second volume envelopes.

8. The system of claim 2, wherein the transition generation unit reorders a sequence of frames within at least one of the first measure grouping and the second measure grouping.

9. The system of claim 2, wherein the transition generation unit replaces frame values within at least one of the first measure grouping and the second measure grouping with external frame values.

10. A system for mixing songs comprising:

a memory unit storing a first startpoint for a first song, wherein the first startpoint corresponds to a first measure grouping in the first song and is selected from first song cuepoints;

a user interface that provides at least one transition mode for selection by a user, wherein the at least one transition mode specifies a priority ranking of the first song cuepoints;

a transition generation unit that generates a transition between the first song and a second song using the first measure grouping; and a player that plays at least a portion of the first song, followed by the transition, followed by at least a portion of the second song.

11. A method for mixing songs comprising:

identifying first song cuepoints in a first song;

identifying second song cuepoints in a second song;

choosing a first startpoint from the first song cuepoints, wherein the first startpoint corresponds to a first measure grouping in the first song and the step of choosing a first startpoint from the first song cuepoints comprises tracking playback of the first song using a playhead frame number and using the playhead frame number to select the first startpoint from the first song cuepoints;

choosing a second startpoint from the second song cuepoints, wherein the second startpoint corresponds to a second measure grouping in the second song; and generating a transition between the first song and the second song using the first measure grouping and the second measure grouping.

12. The method of claim 11, wherein the step of generating a transition between the first song and the second song using the first measure grouping and the second measure grouping comprises reordering a sequence of frames within at least one of the first measure grouping and the second measure grouping.

13. The method of claim 11, wherein the step of generating a transition between the first song and the second song using the first measure grouping and the second measure grouping comprises replacing frame values within at least one of the first measure grouping and the second measure grouping with external frame values.

14. A non-transitory computer readable medium comprising computer executable instructions adapted to perform the method of claim 11.

15. A method for mixing songs comprising:

identifying first song cuepoints in a first song;

identifying second song cuepoints in a second song;

choosing a first startpoint from the first song cuepoints, wherein the first startpoint corresponds to a first measure grouping in the first song;

calculating a first volume envelope for the first measure grouping;

calculating second volume envelopes for measure groupings marked by the second song cuepoints;

generating combinations of the first volume envelope with each of the second volume envelopes;

choosing a second startpoint from the second song cuepoints based on a comparison of the combinations, wherein the second startpoint corresponds to a second measure grouping in the second song; and generating a transition between the first song and the second song using the first measure grouping and the second measure grouping.

16. The method of claim 15, wherein the first volume envelope comprises an energy level for at least one frequency band for the first measure grouping.

17. The method of claim 15, wherein each of the second volume envelopes comprises an energy level for at least one frequency band for one of the measure groupings marked by the second song cuepoints.

18. The method of claim 15, wherein the step of choosing a second startpoint from the second song cuepoints based on a comparison of the combinations comprises selecting a subset of second song cuepoints corresponding to combinations within a specified tolerance of a desired volume envelope.

* * * * *